US007728858B2

(12) United States Patent
Hara et al.

(10) Patent No.: US 7,728,858 B2
(45) Date of Patent: Jun. 1, 2010

(54) IMAGE FORMING APPARATUS AND IMAGE FORMING METHOD

(75) Inventors: Yukio Hara, Kanagawa (JP); Isao Ito, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 30 days.

(21) Appl. No.: 11/604,024

(22) Filed: Nov. 24, 2006

(65) Prior Publication Data

US 2008/0012926 A1 Jan. 17, 2008

(30) Foreign Application Priority Data

Jul. 13, 2006 (JP) ..... 2006-192858

(51) Int. Cl.
*B41J 2/385* (2006.01)
*G03G 13/01* (2006.01)
*G03C 1/72* (2006.01)

(52) U.S. Cl. ..... 347/158; 347/155; 347/156; 430/42.1; 430/45.1; 430/45.33; 430/138

(58) Field of Classification Search ..... None
See application file for complete search history.

(56) References Cited

U.S. PATENT DOCUMENTS 2,800,457 A 7/1957 Green et al.
2,800,458 A 7/1957 Green et al.
3,111,407 A 11/1963 Linquist et al.
3,287,154 A 11/1966 Hass et al.
3,418,250 A 12/1968 Vassiliades
3,660,304 A 5/1972 Matsukawa
3,796,669 A 3/1974 Kiritani et al.
3,914,511 A 10/1975 Vassiliades (Continued)

FOREIGN PATENT DOCUMENTS

GB 930422 7/1963

(Continued)

OTHER PUBLICATIONS

Unpublished U.S. Appl. No. 11/603,842, filed Nov. 24, 2006 (Kimura et al.).

(Continued)

*Primary Examiner*—Matthew Luu
*Assistant Examiner*—Kendrick X Liu
(74) *Attorney, Agent, or Firm*—Morgan, Lewis & Bockius LLP

(57) ABSTRACT

An image forming apparatus uses toner that is given color-generation information and a color-generation state or a non-color-generation state of the toner is controlled, and includes an image carrier, a unit that forms toner image on the image carrier, an intermediate transfer medium that the toner image formed on the image carrier is transferred to, a first transfer unit that transfers the toner image to the intermediate transfer medium surface, a unit that gives color-generation information to the toner image transferred to the intermediate transfer medium, a second transfer unit that transfers the toner image transferred to the intermediate transfer medium surface to a recording medium, a unit that fixes the toner image transferred to the recording medium and a unit that causes color generation in the toner image that the color-generation information is given.

8 Claims, 9 Drawing Sheets

U.S. PATENT DOCUMENTS

| | | | | |
|---|---|---|---|---|
| 4,001,140 | A | 1/1977 | Foris et al. | |
| 4,025,455 | A | 5/1977 | Shackle | |
| 4,087,376 | A | 5/1978 | Foris et al. | |
| 4,089,802 | A | 5/1978 | Foris et al. | |
| 4,933,708 | A * | 6/1990 | Asano et al. | 355/403 |
| 5,060,020 | A * | 10/1991 | Sakai | 399/223 |
| 5,202,722 | A * | 4/1993 | Ohta | 355/400 |
| 6,303,259 | B1 * | 10/2001 | Kubo et al. | 430/138 |
| 6,838,494 | B2 * | 1/2005 | Chundury et al. | 523/135 |
| 2002/0015595 | A1 * | 2/2002 | Harada et al. | 396/575 |
| 2004/0008245 | A1 * | 1/2004 | Hirai et al. | 347/129 |
| 2004/0076897 | A1 * | 4/2004 | Kawada et al. | 430/45 |
| 2004/0208678 | A1 * | 10/2004 | Yoda et al. | 399/302 |

FOREIGN PATENT DOCUMENTS

| | | |
|---|---|---|
| GB | 952807 | 3/1964 |
| GB | 965074 | 7/1964 |
| GB | 990443 | 4/1965 |
| JP | B-36-9168 | 6/1961 |
| JP | B-38-19574 | 9/1963 |
| JP | B-42-446 | 1/1967 |
| JP | B-42-771 | 1/1967 |
| JP | A-51-9079 | 1/1976 |
| JP | A-63-311364 | 12/1988 |
| JP | A-4-101885 | 4/1995 |
| JP | A-9-263057 | 10/1997 |
| JP | 2003330228 A * | 11/2003 |
| JP | A-2003-330228 | 11/2003 |

OTHER PUBLICATIONS

Unpublished U.S. Appl. No. 11/603,979, filed Nov. 24, 2006 (Maeyama).
Unpublished U.S. Appl. No. 11/603,980, filed Nov. 24, 2006 (Furuya).
Unpublished U.S. Appl. No. 11/604,025, filed Nov. 24, 2006 (Kashimura).
Unpublished U.S. Appl. No. 11/604,031, filed Nov. 24, 2006 (Ito).
Unpublished U.S. Appl. No. 11/604,036, filed Nov. 24, 2006 (Kimura et al.).
Unpublished U.S. Appl. No. 11/604,044, filed Nov. 24, 2006 (Ito).
Unpublished U.S. Appl. No. 11/604,048, filed Nov. 24, 2006 (Kimura et al.).
Unpublished U.S. Appl. No. 11/604,049, filed Nov. 24, 2006 (Takegawa).

* cited by examiner

IMAGE FORMING APPARATUS AND IMAGE FORMING METHOD

BACKGROUND (1) Technical Field

The present invention relates to an image forming apparatus and an image forming method.

(2) Related Art

In recording apparatus hitherto used for forming color images in accordance with an electrophotographic system, fundamental three primary colors are developed according to information on their respective images and these toner images are superposed one by one, and thereby color images are obtained. As to a specific apparatus configuration, there is known the so-called 4-cycle machine in which development of latent images formed on one photoconductor drum according to a method of image formation is performed for each color and transfer of developed color images onto a transfer member is repeated for each color, and thereby color images are obtained; or a tandem machine in which a photoconductor drum and a developing device are installed for an image forming unit of each color and toner images are continuously transferred onto a transfer member one after another by travel of the transfer member, and thereby color images are obtained.

At least one thing these machines have in common is that plural developing devices are provided for colors to which they are allocated, respectively. Therefore, usual color image formation requires 4 developing devices for three primary colors plus black color, and a tandem machine further requires not only 4 photoconductor drums responding to 4 developing devices but also an unit for harmonizing the synchronization among these 4 image forming units; as a result, upsizing of the apparatus and a cost increase become unavoidable.

SUMMARY

According to an aspect of the invention, an image forming apparatus comprises: an image carrier; a toner image forming unit that uses a developer containing a toner and forms an toner image on the image carrier surface, the toner being given color information and a color-generation state or non-color-generation state of the toner being controlled; an intermediate transfer medium that the toner image formed on the image carrier is transferred to; a first transfer unit that transfers the toner image formed on the image carrier surface to the intermediate transfer medium surface; a color-generation information giving unit that gives color-generation information to the toner image transferred to the intermediate transfer medium; a second transfer unit that transfers the toner image transferred to the intermediate transfer medium surface to a recording medium; a fixing unit that fixes the toner image transferred to the recording medium surface; and a color generating unit that causes color generation in the toner image that the color-generation information is given.

BRIEF DESCRIPTION OF THE DRAWINGS

Exemplary embodiments of the invention will be described in detail based on the following figures, wherein.

DETAILED DESCRIPTION

Figure 1:
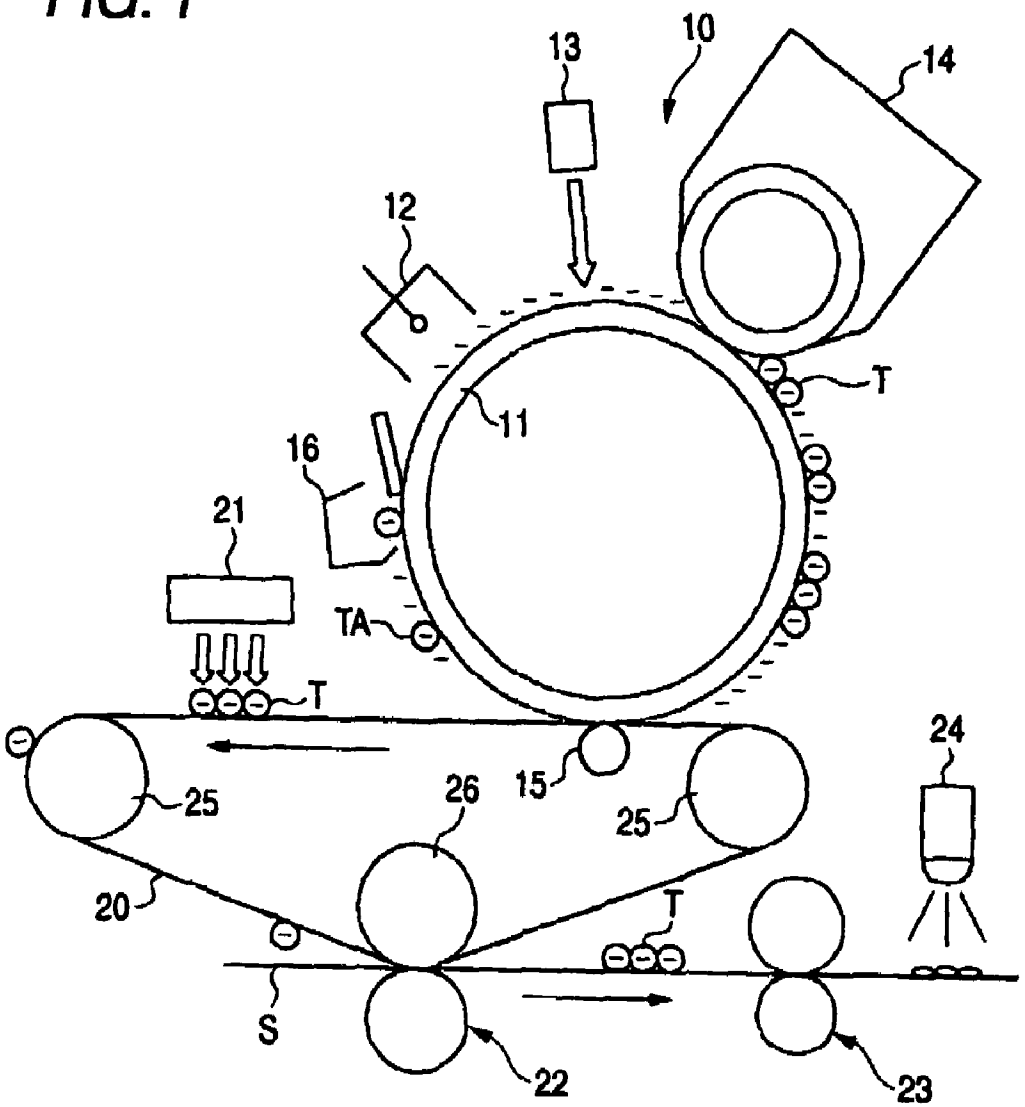
FIG. 1 is a schematic configurational diagram showing an example of an image forming apparatus according to a first exemplary embodiment of the invention.

The invention is illustrated below by reference to drawings. Additionally, the same reference numeral or sign is assigned to members having substantially the same function in all the drawings, so overlapping explanations are omitted in some cases.

First Exemplary Embodiment

FIG. 1 is a schematic configurational diagram showing an example of an image forming apparatus according to a first exemplary embodiment of the invention.

An image forming apparatus according to a first exemplary embodiment, as shown in FIG. 1, is provided with an image forming unit 10 that forms a toner image T by use of toner, an intermediate transfer belt 20 to which the toner image T formed on the image forming unit 10 is transferred, a color-generation information giving device 21 (color-generation information giving unit) that gives color-generation information to the toner image T transferred to the intermediate transfer belt, a second transfer device 22 (second transferring unit) that transfers the toner image to the surface of a recording medium S, a fixing device 23 that fixes the toner image T transferred to the recording medium S surface by application of heat, or pressure, or both, and a light irradiation device 24 (light irradiating unit) that is placed on the downstream side of the fixing device 23 and performs light irradiation of the recording medium S for fixing generated colors of the toner image T. The fixing device 23 also serves as a color generation device (color generating unit) that causes the toner image T to generate colors.

The image forming unit 10 is equipped with a photoconductor 11 (image carrier) and, around the photoconductor, further has a charging device 12 (charging unit) that uniformly produces negative charge on the photoconductor 11, an exposure device 13 (exposing unit) that forms an electrostatic latent image by exposing the surface of the photoconductor 11 to light in accordance with image information, a developing device 14 (developing unit) that forms toner image T by developing the electrostatic latent image with a developer containing negatively charged toner, a first transfer device 15 (first transferring unit) that transfers the toner image T to the surface of an intermediate transfer belt 20, and a cleaning device 16 that eliminates residual toner TA remaining on the photoconductor 11 after transfer.

Additionally, the intermediate transfer belt 20 is stretched in a tensioned state by not only two tension stretching rolls 25 but also a backup roll 26 placed opposite to the second transfer device 22 via the intermediate transfer belt 20.

Toner applied in the image forming apparatus according to this exemplary embodiment of the invention has a function that, when each individual toner particle, for example, is exposed to light with different wavelengths, it retains a state of generating the color corresponding to each wavelength, or a state of not generating the color (non-color-generation state). More specifically, the toner has inside the toner itself color generating substances (and further color generation areas containing these substances) capable of generating colors by being given color-generation information by means of light, so the retention of toner's color-generation state or non-color-generation state is controlled by giving color-generation information by means of light.

The expression "giving color-generation information by means of light" as used herein means that at least one kind of light with a specific wavelength is given selectively to the desired area of a toner image made up of toner particles or no light is given thereto in order to control the state of generating or not generating color and the tone of the generated color on an individual toner particle basis.

Such toner has no particular restriction so far as it can fulfill the foregoing function, and examples thereof may include the toners disclosed in JP-A-63-311364 and JP-A-2003-330228 and toners described below as those usable in exemplary embodiments of the invention.

In an image forming apparatus according to this exemplary embodiment, to begin with, the toner as mentioned above is used in an image forming unit 10, and negative charge is given uniformly to a photoconductor 11, the negatively charged photoconductor 11 undergoes light exposure in logic sum of image forming information, e.g., on three colors of cyan (C), magenta (M) and yellow (Y), thereby forming an electrostatic latent image on the photoconductor 11, and then the latent image is developed with a developer including the negatively charged toner to form a toner image T (toner image forming step). Next the toner image T given the color-generation information is transferred to an intermediate transfer belt 20 (first transfer step). Thereafter, residual toner TA remaining on the photoconductor 11 after the transfer is eliminated (cleaning step).

And, on the intermediate transfer belt 20, the toner image T is exposed to light with wavelengths corresponding to the color information and thereby color-generation information is given to the toner image T (color-generation information giving step). Thereafter, the toner image T bearing the color-generation information is transferred to a recording medium S, and fixed (second transfer step and fixing step). After, or before, or during this step, color generation reaction of the toner is performed by application of heat (color generation step). Further, the surface of the recording medium S after fixing is irradiated with light to remove and bleach background color (light irradiation step). In this manner, color images are obtained.

Configurations of the image forming apparatus according to this exemplary embodiment are described below following each step of the image forming process.

<Toner Image Forming Step>

In the toner image forming step, to begin with, a photoconductor 11 is charged throughout its surface by means of a charging device 12. Next the surface of the photoconductor 11 is exposed to light according to image information by means of an exposure device 13. Then, electrostatic latent image is developed with a developer containing toner, thereby forming a toner image T.

Herein, any of known photoconductors may be used as the photoconductor 11. For example, a photoconductor made by forming an inorganic photoconductive layer, such as a Se or a-Si layer, or a single organic photoconductive layer or multiple organic photoconductive layers on a drum-shaped conductive base (e.g., a cylindrical body made of a metal like aluminum) can be used. As to a belt-shaped photoconductor, a transparent resin base, such as a PET or PC base, or a nickel seamless belt can be used as the base, and the base thickness is determined depending on the design specifications, including the diameter of rolls by which the belt-shaped photoconductor is stretched in a tensioned condition and the tension applied to the photoconductor, and it is roughly of the order of 10 to 500 μm. Other factors including the layer structure are similar to those in a drum-shaped photoconductor.

On the other hand, a charging device 12 can adopt a known charging unit for charging. In a contact system, a roll, a brush, a magnetic brush or a blade can be used; while, in a non-contact system, a corotron or a scorotron can be used. The charging unit usable herein should not be construed as being limited to the above-recited ones.

Among them, contact chargers may be used from the viewpoint of the balance between a charging compensation capability and an amount of ozone produced. In the contact charging system, the surface of a photoconductor is charged by applying a voltage to a conductive member brought into contact with the photoconductor surface. The shape of the conductive member may be any of brush, blade, pin-electrode and roll shapes. Among those members, a roll-shaped member may be used. The roll-shaped member is usually made up of a resistance layer, an elastic layer supporting the resistance layer and a core material, which are arranged from outer to inner in the order of mention. Further, a protective layer may be provided outside the resistance layer, if needed.

As a method of charging the photoconductor 11 by use of such a conductive member, a voltage is applied to the conductive member. The voltage applied may be a direct voltage, or superposition of an alternating voltage on a direct voltage. The voltage range may be a positive or negative value, as expressed in absolute value, of the order of 500 V plus the desired surface potential when the charging is carried out by direct voltage alone, and specifically it is from 700V to 1,500V. When the alternating voltage is superposed, the direct voltage is roughly of the order of the desired surface potential plus or minus 50 V, the peak-to-peak alternating voltage (Vpp) is from 400V to 1,800V, preferably from 500V to 1,600V, the frequency of the alternating voltage is from 50 Hz to 20,000 Hz, preferably from 100 Hz to 5,000 Hz, and any of sine waves, square waves and triangular waves may be used. The setting of charging potential is preferably adjusted to a range of 150V to 700V, as expressed in absolute value of the potential.

As an exposure device 13, known devices including a laser scanning system, an LED image bar system, an analog exposure unit and an ion-flow control head can be used, and exposure can be given to the surface of the photoconductor 11 as shown by the arrow. In addition to the devices as recited above, novel exposure units developed in the future can be used as long as they can achieve effects of the invention.

As the wavelengths of a light source, wavelengths included in the spectral sensitivity region of the photoconductor 11 are used. Although the mainstream of semiconductor laser hitherto used have been near infrared laser having its oscillation wavelengths in the vicinity of 780 nm, laser having oscillation wavelengths on the order of 600 nm and blue laser having oscillation wavelengths near 400 to 450 nm are also usable. In addition, light sources of surface-emitting laser type which can produce multi-beam output are also effective for formation of color images.

Exposure of the photoconductor 11 by means of the exposure device 13 is performed in logical OR of image forming information on the 4 colors at positions to deposit the toner described below in the case of reversal development, or at positions other than the positions to deposit the toner in the case of normal development. The setting of exposure-spot diameter may be adjusted to a range of 40 to 80 μm in order to attain resolution of 600 to 1,200 dpi. The amount of exposure may be adjusted so that the potential after exposure is to be a range of 5 to 30% of the charging potential. In cases where the development amount of toner is changed according to gradations of image, however, the amount of exposure may be changed according to the amount of development at each exposure position.

As a developing device 14, known developing devices can be used. As to the development method, all of known development methods, including a two-component development method using toner and fine toner-carrying particles referred to as carrier, a one-component development method using toner alone and these methods in which other constituent materials are added for improvements on development and other qualities, can be used.

Depending on the development method, development may be performed in a condition that a developer is either in contact with the photoconductor 11, or in non-contact with the photoconductor 11, or in a combination of these conditions. Further, a hybrid development method as a combination of the one-component development method and the two-component development method can also be used. In addition to these methods, novel development methods developed in the future can be used so long as they can achieve effects of the invention.

The toner included in the developer may contain a color generation area capable of generating Y color (Y color generation area), a color generation area capable of generating M color (M color generation area) and a color generation area capable of generating C color (C color generation area) in each individual toner particle, or may contain the Y color generation area, the M color generation area and C color generation area in separate toner particles.

The development amount of toner (the amount of toner deposited to the photoconductor), though depends on the image formed, is preferably from 3.5 to 8.0 g/m$^2$, far preferably from 4.0 to 6.0 g/m$^2$, in terms of solid image.

Additionally, in the toner image T formed, the toner thickness may be controlled to a certain level or below in order that all the irradiated areas are pervaded with light for giving color-generation information as mentioned hereinafter. More specifically, the toner layer, e.g., in a solid image is preferably in a triple-layer state at the most, far preferably a double-layer state at the most. Incidentally, the number of layers constituting the toner layer is a value obtained by dividing a measurement value of the thickness of the actual toner layer formed on the photoconductor 11 by number average diameter of toner particles.

<First Transfer Step>

In the first transfer step, the toner image T is transferred in bulk to an intermediate transfer belt 20 by means of a first transfer device 15.

Herein, any of known transfer devices may be used as the first transfer device 15. For example, a roll, a brush or a blade can be used in adopting a contact system, and a corotron, a scorotron or a pincorotron can be used in adopting a non-contact system. Further, it is also possible to perform the transfer by application of pressure, or both pressure and heat.

On the other hand, known semiconductive belts can be used as the intermediate transfer belt 20, but suitable examples of the intermediate transfer belt 20 are described hereinafter.

The transfer bias is preferably adjusted to a range of 300 to 1,000 V (absolute value), and an alternating voltage (Vpp: 400V to 4 kV, 400 to 3 kHz) may further be superposed thereon.

<Cleaning Step>

In the cleaning step, residual toner TA remaining on the photoconductor 11 after the transfer using the first transfer device 15 is eliminated with a cleaning device 16. As this cleaning device 16, known devices utilized in electrophotographic processes carried out with usual coloring agents, such as pigments, can be used, and specifically a blade or brush is usable. Additionally, the so-called cleaner-less process wherein the cleaning device 16 is removed is also applicable.

<Others>

In addition to these steps, known steps utilized in electrophotographic processes carried out using usual coloring agents, such as pigments, may be included. For example, an electricity removing device may be placed on the upstream side of a charging device 12 (e.g., an AC corona discharger), and thereby the surface charges of the photoconductor 11 are eliminated before next cycle of image forming process so as to restore an approximately zero potential to the photoconductor 11.

<Color-Generation Information Giving Step>

In the color-generation information giving step, color-generation information is given to the toner image T transferred to an intermediate transfer belt 20 (intermediate transfer medium) by means of light emitted as shown by arrows from a color-generation information giving device 21 situated above the intermediate transfer belt 20 (intermediate transfer medium). Herein, the expression "color-generation information is given by means of light" signifies that at least one kind of light with a specific wavelength is given selectively to the desired area of a toner image T made up of toner particles, or no light is given thereto, in order to control the color-generation/non-color-generation state and the tone of the generated color on an individual toner particle basis. Additionally, as to the position of the color-generation information giving step, this step may be situated after the transfer step as mentioned hereinafter.

The color-generation information giving device 21 may be any of devices as far as they can emit light of wavelengths for causing generation of specified colors in toner particles and cause generation of colors at that moment with designated resolutions and intensities. It is possible to use, e.g., an LED image bar or laser ROS as such a device. Additionally, the spot diameter of light with which the toner image T is irradiated may be adjusted to a range of 10 to 300 μm, preferably to a range of 20 to 200 μm, so that the images formed have resolutions in a range of 100 to 2,400 dpi.

The wavelengths of light applied to retain a color-generation or non-color-generation state are determined by the material design of toner used. When toner that generates colors by irradiation with light of specific wavelengths (photo-color-generating toner) is used, for example, yellow color (Y color), magenta color (M color) and cyan color (C color) are generated by irradiating the toner in positions where the toner is desired to generate colors with light of 405 nm ($\lambda_A$ light), light of 535 nm ($\lambda_B$ light) and light of 657 nm ($\lambda_C$ light), respectively.

Further, in order to generate secondary colors, the toner is irradiated with the foregoing light combinations. More specifically, the combination of $\lambda_A$ light and $\lambda_B$ light for generation of red (R color), the combination of $\lambda_A$ light and $\lambda_C$ light for generation of green (G color) and the combination of $\lambda_B$ light and $\lambda_C$ light for generation of blue (B color) are applied respectively to positions where these colors are desired to generate. Furthermore, in order to generate black (K color) as tertiary color, the $\lambda_A$ light, the $\lambda_B$ light and the $\lambda_C$ light in a superposed state are applied to positions where the black color is desired to generate.

On the other hand, in the case of toner that retains a non-color-generation state by irradiation with light of specific wavelengths (photo-non-color-generating toner), for example, yellow color (Y color), magenta color (M color) and cyan color (C color) are avoided from generating by irradiating the toner in positions where the toner is desired to generate colors with light of 405 nm ($\lambda_A$ light), light of 535 nm ($\lambda_B$ light) and light of 657 nm ($\lambda_C$ light), respectively. Therefore, Y color, M color and C color are generated in positions where the toner is desired to generate these colors by irradiation the toner respectively with combination of $\lambda_B$ light and $\lambda_C$ light, combination of $\lambda_A$ light and $\lambda_C$ light, and combination of $\lambda_A$ light and $\lambda_B$ light.

Further, in order to generate secondary colors, the toner is irradiated with the foregoing light combinations. More specifically, in positions where the colors are desired to generate, the toner are irradiated respectively with $\lambda_C$ light when made to generate red (R color), with $\lambda_B$ light when made to generate green (G color), and with $\lambda_A$ light when made to generate blue (B color). Furthermore, in order to generate black (K color) as tertiary color, light irradiation is avoided in positions where black color is desired to generate.

To the light from the color-generation information giving device 21, known image modulation methods, including pulse-width modulation, intensity modulation and a combination thereof, are applicable, if needed. The amount of light exposure may be adjusted to a range of 0.05 to 0.8 mJ/cm$^2$, preferably a range of 0.1 to 0.6 mJ/cm$^2$. As to the amount of light exposure, there is a correlation between the required amount of light exposure and the amount of toner development, and it is preferable, e.g., that exposure in an amount of 0.2 to 0.4 mJ/m$^2$ is performed when the amount of tone development (solid) is about 5.5/m$^2$.

When the exposure light used is laser light, it is usually required to tilt laser beams incident upon the photoconductor by several degrees (4 to 13 degrees) for preventing the beams from returning to a laser monitor (Photo Detector). At the time of exposure for giving color-generation information in the invention, however, such return light is absorbed by toner and extremely reduced in quantity. So the incident angle of laser beams may be set at any value, including zero.

Further, in relation to the above, the color-generation information giving device 21 and the exposure device 13 for latent-image formation may be placed in the same cabinet. By doing so, partial sharing among exposure devices including optical systems and simplification of them become possible, and further downsizing of the apparatus as a whole can be made.

The timing of the exposure for giving color-generation information is performed and the position control of such exposure are described below in brief.

Figure 2:
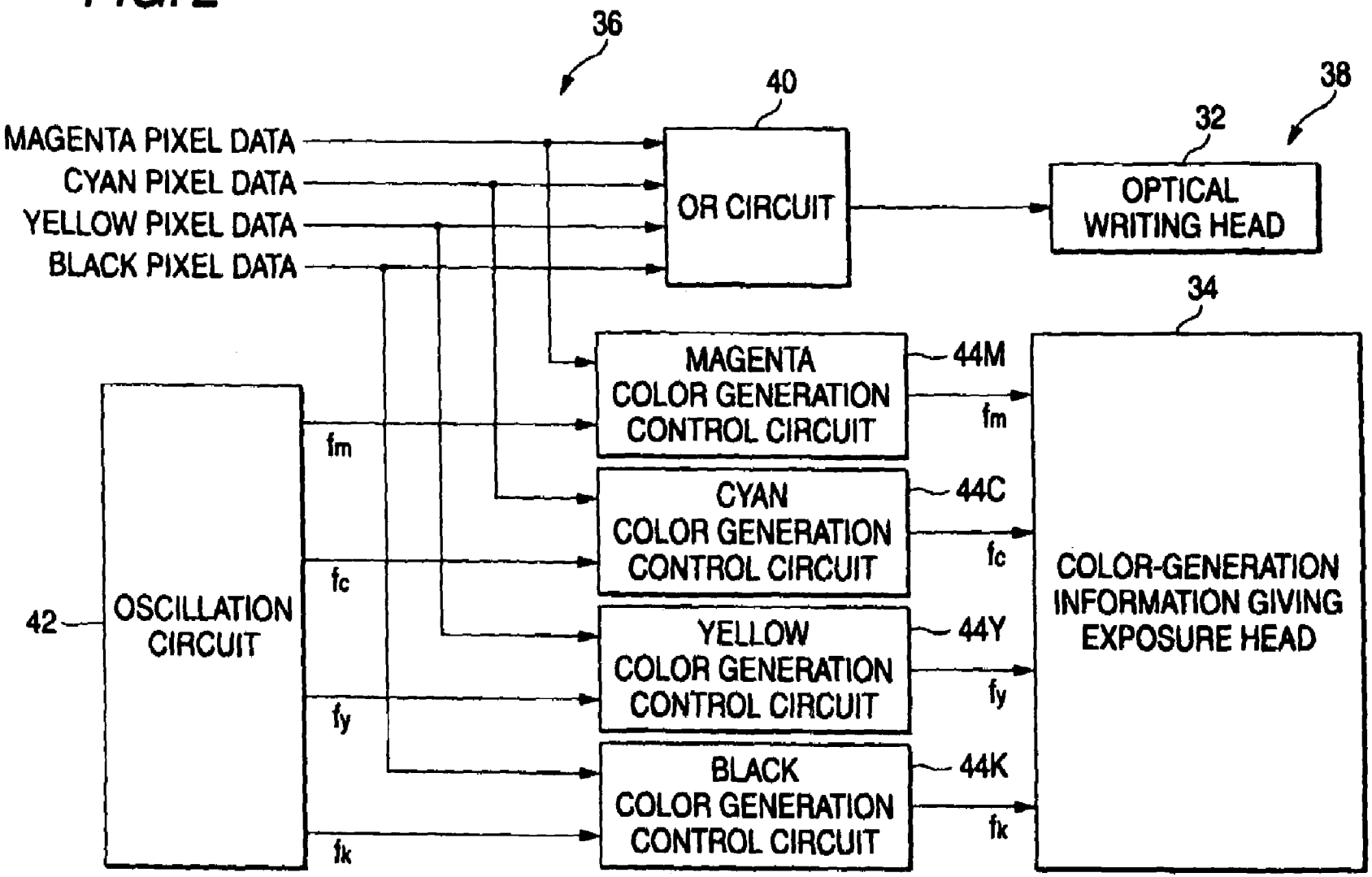
FIG. 2 is a circuit block diagram of a print controller.

FIG. 2 shows a specific circuit block diagram of a print controller. In this figure, the printer controller 36 is made up of an OR circuit 40, an oscillation circuit 42, a magenta color generation control circuit 44M, a cyan color generation control circuit 44C, an yellow color generation control circuit 44Y and a black color generation control circuit 44K. On the other hand, the exposure section 38 is made up of an optical writing head 32 and a color-generation information giving light exposure head 34.

RGB signals input through an interface (I/F) not shown in the figure are converted into CMYK values, the image data thus obtained is further output as pixel data on magenta (M), cyan (C), yellow (Y) and black (K) to the OR circuit 40 from the interface (I/F). Herein, the OR circuit 40 calculates a logical sum of CMYK and outputs the logical sum to the optical writing head 32.

More specifically, the logical sum data including all the pixel data on CMYK is output to the optical writing head 32, and optical writing on the photoconductor 11 is carried out as mentioned above. Therefore, an electrostatic latent image based on the logical sum data including all the pixel data on CMYK is formed on the periphery of the photoconductor 11.

In addition, the pixel data on CMYK is also provided to their corresponding magenta color generation control circuit 44M to black color generation control circuit 44*k*, and output to the color-generation information giving exposure head 34 in synchronization with oscillation signals fm, fc, fy and fk output from an oscillation circuit 42. More specifically, color generation data corresponding to magenta (M), cyan (C), yellow (Y) and black (K), respectively, is provided to the color-generation information giving exposure head 34, and the toner image T developed on the photoconductor 11 is irradiated with light of specific wavelengths for retaining a color-generation or non-color-generation state in correspondence with the type of toner used. Accordingly, photo-curing reaction as described hereinafter occurs inside the light-irradiated toner to provide color-generation information.

For example, the color generation signal fm output from the magenta color generation control circuit 44M creates a state that color generation areas in the toner are irradiated with the $\lambda_B$ light and the toner is enabled to generate magenta (M) color. In addition, the color generation signal fc output from the cyan color generation control circuit 44C creates a state that color generation areas in the toner are irradiated with the $\lambda_C$ light and the toner is enabled to generate cyan (C) color. Further, the same way as the above is applied to generation of yellow (Y) and black (K) colors, so the color generation signals fy and fk output from the yellow color generation control circuit 44Y and the black color generation control circuit 44K create states that color generation areas in the toner are irradiated with the $\lambda_A$ light and a combination of the $\lambda_A$ light, the $\lambda_B$ light and the $\lambda_C$ light and the toner is enabled to generate yellow (Y) color and black (K) color, respectively.

Additionally, although a mechanism for performing full color image formation in the color-generation information giving step (unit) is described above, the color-generation information giving step may be a color-generation information giving step for mono-color image formation wherein any of yellow, magenta and cyan colors is generated. In this case, only light with the specific wavelength corresponding to generation of the desired color among the three colors, namely yellow, magenta and cyan colors, is emitted from the color-generation information giving exposure head 34. Other favorable conditions are similar to those in full-color image formation.

In this stage, however, the toner image T made of toner is in a state that no color is yet generated but the toner keeps its original tone, so the toner image T, when sensitized with a dye, assumes little more than the tone of the dye.

On the other hand, when the toner of photo-non-color-generating type is used, formation of only black-and-white image requires no color-generation information giving unit, so a recording apparatus is configured to form black and white image alone as a first step and, at a future time when demand for color image formation comes to grow, the recording apparatus can also be extended to meet color image formation by addition of color-generation information giving devices.

<Second Transfer Step>

In the second transfer step, each toner image transferred to the intermediate transfer belt 20 is transferred to the surface of a recording medium S by means of a second transfer device 22.

Herein, any of known transfer devices can be used as the second transfer device 22, and the details thereof are similar to those of the first transfer device 15.

<Fixing Step and Color Generation Step>

In the fixing step and the color generation step, the toner image T kept in a state that color generation is enabled (or kept in a non-color-generation state) is fixed through heating of the recording medium S by means of a fixing device 23 and, at the same time, the color generation of the toner is effected. As the fixing device 23, any of known fixing units can be used. For examples, a roll or a belt can be chosen as each of heating and pressurizing members, and a halogen lamp or IH can be used as a heat source. Its configuration is also adaptable to a variety of paper transport paths, such as a straight path, a rear C path, a front C path, an S path and a side C path.

Figure 3:
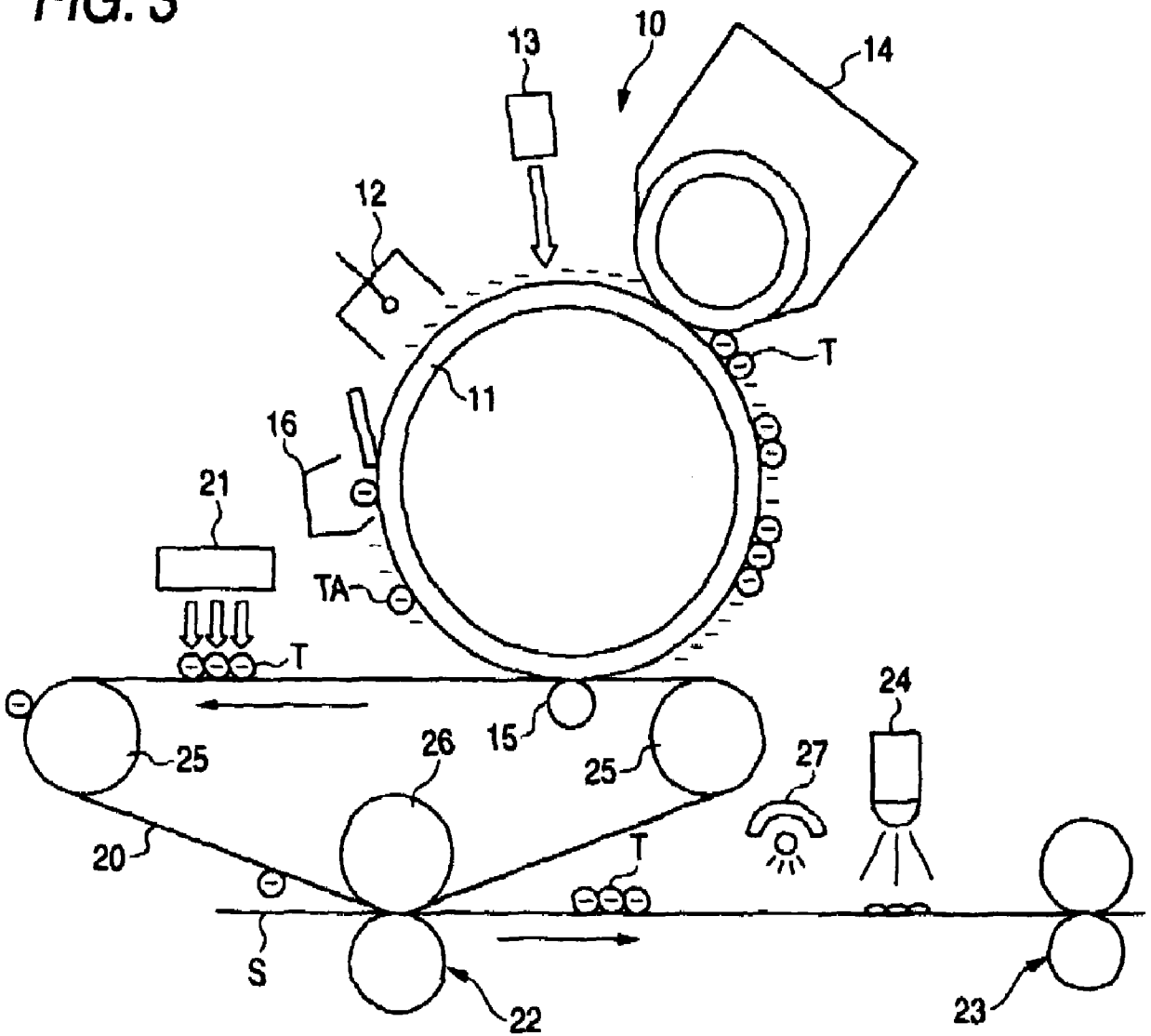
FIG. 3 is a schematic configurational diagram showing another example of an image forming apparatus according to a first exemplary embodiment of the invention.

Although the color generation step and the fixing step are combined by the fixing device 23 in the above exemplary embodiment, the color generation step may be provided separately from the fixing step. A color generation device for carrying out the color generation step has no particular restriction as to where it is disposed but, as shown in FIG. 3, it is also possible to place the color generation device 27 and the light irradiation device 24 on the upstream side of the fixing device 23. By doing so, the heating temperature for color generation and the heating temperature for fixation of toner to a recording medium S can be controlled independently, and the degree of flexibility in designing color generation materials and toner binder materials can be heightened.

In this case, various color generation methods according to mechanisms for causing color generation in toner particles can be thought. For instance, in the color generation device 27 (color generating unit), color generation is caused, e.g., by a method of causing a material involved in color generation to cure or photo-decompose in the toner by further using light with a different wavelength; or in a limiting method, color generation is caused by a device for emitting specific light and a method of destroying encapsulated color-generation particles by pressurization; or in a limiting method, a pressure device is used.

However, such chemical reactions for causing color generation are generally dependent on migration or diffusion and slow in reaction speed. So, it is required to supply sufficient diffusion energy whichever method is chosen. From this point of view, it can be said that the method of promoting reaction by heating is outstanding. Accordingly, it may also use the fixing device 23 performing both the color generation step and the fixing step from the space-saving point of view.

<Light Irradiation Step>

In a light irradiation step, image obtained by undergoing fixing and color generation steps is irradiated with light by means of a light irradiation device 24. By this step, reactive substances remaining in color generation areas controlled to a state that color generation of toner is made impossible can be decomposed or deactivated, so it becomes possible to suppress variations in color balance after image formation with more certainty, and to remove and bleach background color.

Additionally, although the light irradiation step is provided after the fixing step in the exemplary embodiment, the fixing step may also be performed after the light irradiation step when a fixing method which does not use fusion by heating, such as a fixing method using pressure, is adopted.

Herein, the light irradiation device 24 has no particular restriction so long as it can prevent color generation of the toner from progressing any further, and known lamps, such as a fluorescent lamp, LED and EL, can be used. As to the wavelengths of such lamps, light for making the toner generate colors has three wavelengths, the illuminance thereof may be of the order of 2,000 to 200,000 lux and the exposure time may be from 0.5 to 60 sec.

In the foregoing manner, color images using toner can be obtained.

In the image forming apparatus according to this exemplary embodiment illustrated above, after the toner image T is transferred to the intermediate transfer belt 20, color-generation information is given to the toner image T transferred onto the intermediate transfer belt 20. Therefore, the photoconductor 11 can avoid undergoing deterioration by exposure for giving color-generation information. In addition thereto, since the exposure for giving color-generation information is carried out as the toner image T is held on the intermediate transfer belt 20, the color-generation information can be given with high accuracy. Accordingly, images free of image-quality defects can be obtained consistently over a long period of time.

Figure 4:
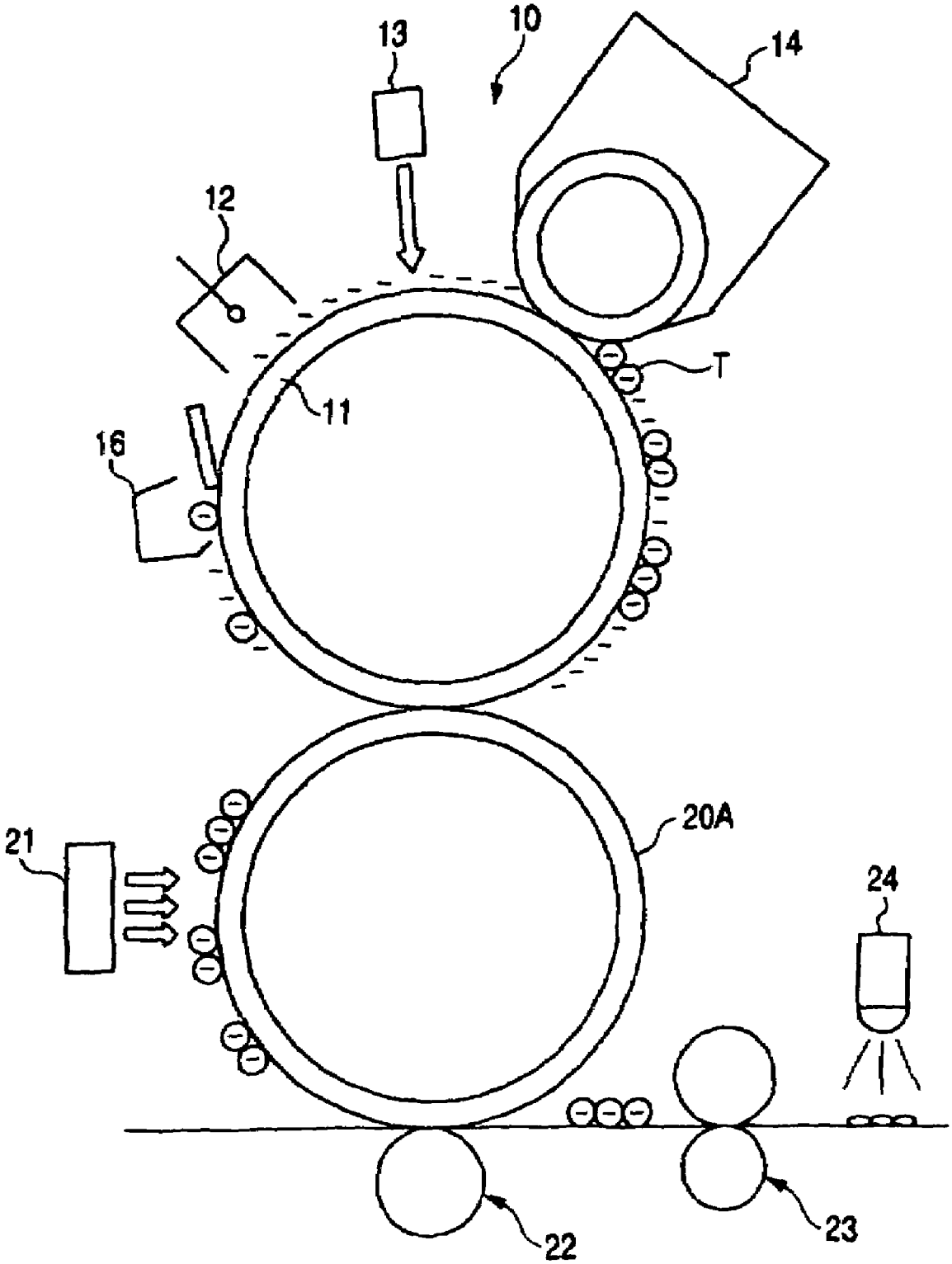
FIG. 4 is a schematic configurational diagram showing still another example of an image forming apparatus according to a first exemplary embodiment of the invention.

Additionally, as to the image forming apparatus according to this exemplary embodiment, the mode of utilizing the intermediate transfer belt 20 as an intermediate transfer medium is illustrated. However, without limiting to this mode, a mode using as the intermediate transfer medium an intermediate transfer drum 20A as shown in FIG. 4 may be adopted.

Further, as to the image forming apparatus according to this exemplary embodiment, the mode of utilizing the so-called electrophotographic process as the image forming process is illustrated. Herein, however, it is also possible to adopt ionography, namely an imaging process in which the image carrier is a dielectric, the toner image forming unit includes a charging unit for charging the surface of the dielectric, an ion writing unit for forming latent image by providing the dielectric surface with ion opposite in polarity to the electrification charge of the dielectric and a developing unit for converting the electrostatic latent image to toner image by use of a developer containing toner, and the toner image is formed through formation of electrical latent image on a dielectric as the image carrier by carrying out an ion-writing operation.

Second Exemplary Embodiment

Figure 5:
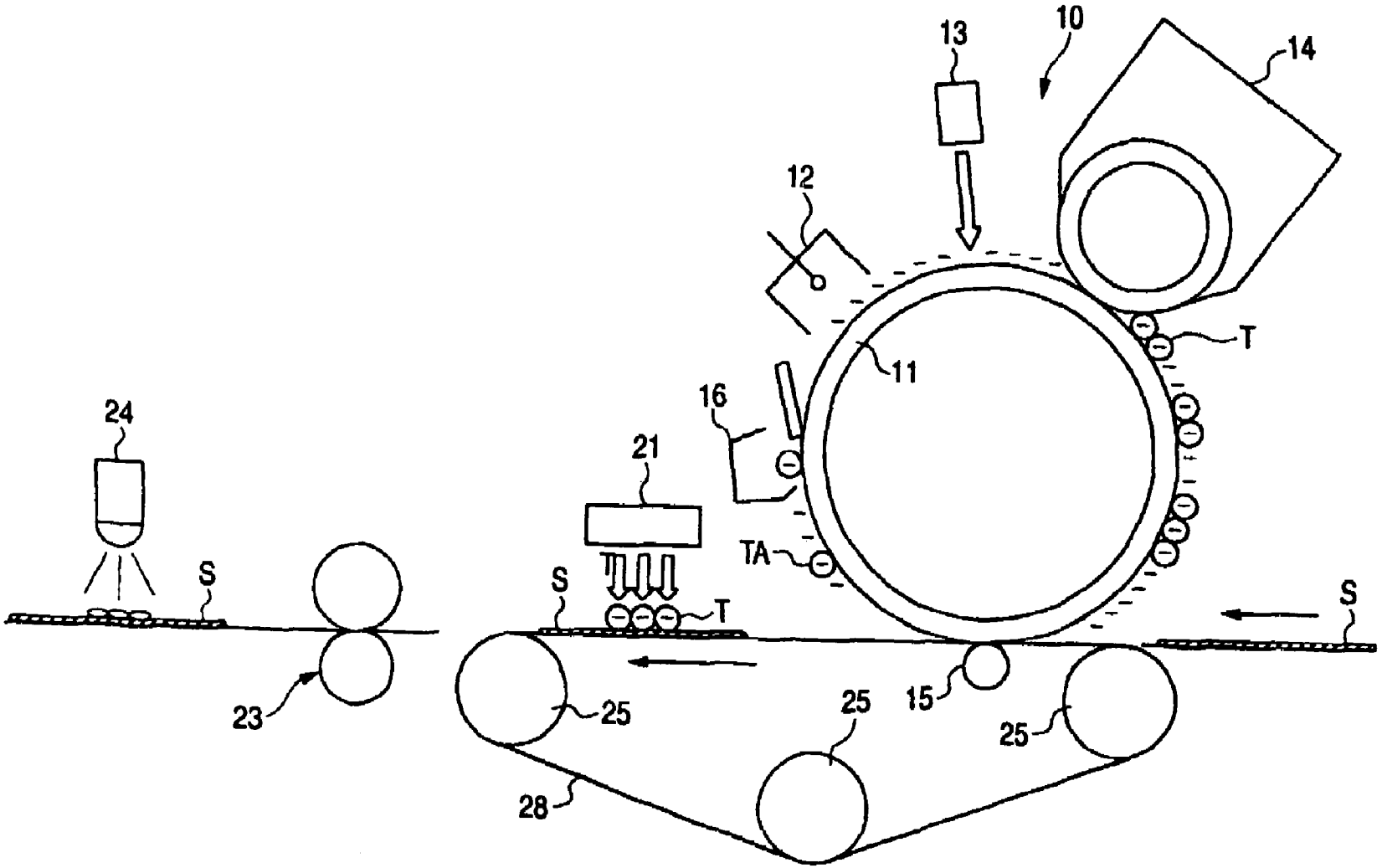
FIG. 5 is a schematic configurational diagram showing an example of an image forming apparatus according to a second exemplary embodiment of the invention.

FIG. 5 is a schematic configurational diagram showing the image forming apparatus according to a second exemplary embodiment.

As shown in FIG. 5, the image forming apparatus according to a second exemplary embodiment adopts a mode that a transport-to-transfer belt 28 (paper transport belt) for transporting a recording medium S to a transfer region is installed, the toner image T formed on the photoconductor 11 is transferred directly to the recording medium S and, on the transport-to-transfer belt, color-generation information is given to the toner image T transferred to the recording medium S by means of a color-generation information giving device 21. Except for this mode, the apparatus is similar to the apparatus according to the first exemplary embodiment, so further explanations thereof are omitted.

Herein, known semiconductive belts can be used as the transport-to-transfer belt 28, and suitable examples thereof are described below.

In the image forming apparatus according to this exemplary embodiment, the toner image T is transferred to the recording medium S transported to a transfer region by the transport-to-transfer belt 28, and then, on the transport-to-transfer belt 28, color-generation information is given to the toner image T transferred to the recording medium S. Therefore, the photoconductor 11 can avoid undergoing deterioration by exposure for giving color-generation information. In addition thereto, since light for giving color-generation information is applied to the toner image T transferred to the recording medium S as the recording medium S is held on the transport-to-transfer belt 28, the color-generation information can be given with high accuracy. Accordingly, images free of image-quality defects can be obtained consistently over a long period of time.

Examples of an intermediate transfer belt and a transport-to-transfer belt (which are both referred to as "semiconductive belt" hereinafter) which can suitably used in the image forming apparatus according to this exemplary embodiment are described below.

The semiconductive belt can be made up of an endless base material alone, or a base material and a surface layer formed on the base material.

Examples of a resin material making up such a base material include polyimide resin, polyamideimide resin, fluorinated resin, vinyl chloride-vinyl acetate copolymer, polycarbonate resin, polyethylene terephthalate resin, vinyl chloride resin, ABS resin, polymethyl methacrylate resin and polybutylene terephthalate resin. These resins may be used alone or as combinations of two or more thereof. Of these resins, polyimide resin can be used to advantage in terms of both high strength and low bending fatigue.

Further, such a resin material is blended with an elastic material, and used as the base material. Examples of such an elastic material include polyurethane, chlorinated polyisoprene, NBR, chloroprene rubber, EPDM, hydrogenated polybutadiene, butyl rubber and silicone rubber.

When a base material has a Young's modulus of about 2,000 MPa or above, preferably 3,000 MPa or above, far preferably 4,000 MPa or above, it can satisfy mechanical properties as a belt base, and a belt member as an intermediate transfer medium or a transport-to-transfer belt can be prevented from becoming warped and it becomes possible to give color-generation information on the intermediate transfer medium or the transport-to-transfer belt with high accuracy.

Herein, the relationship between the Young's modulus of a semiconductive belt and the amount of displacement caused in the belt by disturbance (load variation) at the time of belt drive can be represented by the following equation;

$$\Delta l = P \cdot l \cdot \alpha / (t \cdot w \cdot E)$$

where $\Delta l$ is the amount of displacement caused in the belt (μm), P is the load (N), l is the length of the belt between 2 tension rolls (mm), $\alpha$ is a coefficient, t is the thickness of the belt (mm), w is the width of the belt (mm) and E is the Young's coefficient ($N/mm^2$) of the belt material (base material).

The expansion and contraction (the amount of displacement) caused in the belt by disturbance (load variation) at the time of belt drive is inversely proportional to the Young's modulus and thickness of the belt material. When the belt material used has a high Young's modulus, the amount of displacement caused in the belt by disturbance (load variation) at the time of belt drive becomes small, so the belt deformation caused by stresses at drive time becomes small and good image quality can be obtained consistently. However, a belt having great thickness causes a problem that the amount of displacement caused in a belt-curved region, such as the region on a drive roll, becomes greater on the outer surface side and good image quality becomes difficult to attain, and besides, a deformation difference between outer and inner sides of the belt becomes great and sometimes results in rupture of the belt owing to locally repeated stresses.

As to the Young's modulus, pursuant to JISK6251, a semiconductive belt is stamped into the belt shape of JIS No. 3 and subjected to a tensile test. A tangent is drawn to the curve as the stress vs. distortion plots in the initial distortion region, and the Young's modulus of the belt can be determined from the slope of the tangent.

On the other hand, a resin material making up a surface layer of the belt may be, e.g., fluorinated resin, polyurethane, polyamide or polyester.

In the base material and the surface layer, a conductive agent can be mixed for the purpose of making resistant adjustment in order to render the belt semiconductive. Examples of a conductive agent usable for such a purpose include conductive agents capable of imparting electron conductivity and conductive agents capable of imparting ion conductivity. These conductive agents may be added alone or as combinations of two or more thereof.

Examples of a conductive agent capable of imparting electron conductivity include carbon black, graphite, metals or alloys such as aluminum, nickel and copper alloys, and metal oxides such as tin oxide, zinc oxide, potassium titanate, and compound oxide of tin oxide and indium oxide or compound oxide of tin oxide and antimony oxide.

Examples of a conductive agent capable of imparting ion conductivity include sulfonates, ammonium salts and various kinds of cationic, anionic and nonionic surfactants. In addition, the method of blending a conductive polymer may be adopted. Examples of such a conductive polymer include quaternary ammonium base-attached polymers, such as (e.g., styrene) copolymer of (meth)acrylate having a quaternary ammonium base attached to its carboxyl group and copolymer of quaternary ammonium base-attached maleimide and methacrylate; alkali metal sulfonate-attached polymers, such as sodium polysulfonate; polymers having at least hydrophilic units of alkyl oxides introduced in their molecular chains, such as polyethylene oxide, polyamide copolymers of polyethylene glycol type, polyethylene oxide-epichlorohydrin copolymer polyether amide imide and block polymers having polyethers as main segment; and further, polyaniline, polythiophene, polyacetylene, polypyrrole and polyphenylenevinylene. These conductive polymers can be used in a dedoping state or in a doping state.

When the conductive agent used has good dispersibility in a resin composition, not only variations in resistance of the semiconductive belt can be reduced, but also electric field dependence becomes weak, and further electric-field concentration by transfer voltage becomes difficult to occur. As a result, the stability of electric resistance during a lapse of time is enhanced. Accordingly, acidic carbon black of pH 5 or below can be used to advantage.

The acidic carbon black of pH 5 or below can be prepared by giving oxidation treatment to carbon black to form carboxyl groups, quinone groups, lactone groups or hydroxyl groups on the particle surface of carbon black. The oxidation treatment can be performed using an air oxidation method of causing carbon black to react with contact air under high-temperature atmosphere, a method of causing carbon black to react with nitrogen oxide or ozone at room temperature, or a method of carrying out air oxidation under high temperature and then ozone oxidation under low temperature. More specifically, acidic carbon black of pH 5 or below can be produced by a contact method. Examples of this contact method include a channel method and a gas black method. Further, the acidic carbon black can also be produced by a furnace black method using gas or oil as a raw material. In addition, liquid-phase oxidation treatment with nitric acid may be carried out after the treatment as recited above, if desired.

Although the acidic carbon black can be produced by contact methods, it is generally produced by a closed furnace method. In general the furnace method provides only high-pH carbon black containing a low content of volatile component, but it is possible to make pH adjustment to this carbon black by giving the foregoing liquid-phase oxidation treatment. Therefore, the carbon black produced by a furnace method and further adjusted to pH 5 or below by after treatment is also regarded as being included in acidic carbon black of pH 5 or below.

The pH value of acidic carbon black is preferably 5.0 or below, far preferably 4.5 or below, further preferably 4.0 or below. Since the carbon whose pH is adjusted to 5.0 or below by oxidation treatment has on its outer surface oxygen-containing functional groups, such as carboxyl groups, hydroxyl groups, quinone groups or lactone groups, its dispersibility in resin is good, and satisfactory dispersion stability is obtained. Therefore, not only variations in resistance of the semiconductive belt can be reduced, but also electric field dependence becomes weak, and further electric-field concentration by transfer voltage becomes hard to occur.

The pH of acidic carbon black can be determined by preparing an aqueous suspension of acidic carbon black and measuring the pH of the suspension with a glass electrode. Additionally, the pH of the carbon black can be adjusted by condition settings in oxidation treatment process, including treatment temperature and treatment time.

The volatile component content in acidic carbon black may be from 1 to 25 mass %, preferably from 3 to 20 mass %, far preferably from 3.5 to 15 masse. When the volatile component content is lower than 1 mass %, effects of oxygen-containing functional groups attached to the outer surface can hardly be produced and the dispersibility in binding resin is sometimes reduced. When the volatile component content is higher than 25 mass %, on the other hand, there sometimes occurs decomposition at the time of dispersion into resin composition or deterioration of a surface layer's or base material's outward appearance by an increase in the amount of water adsorbed to oxygen-containing functional groups on the surface.

In contrast to the above cases, adjustment of the volatile component content to the range of 1 to 25 mass % can make it possible to achieve more satisfactory dispersion into the resin composition. Incidentally, the volatile component content can be determined by the proportion of organic volatile components (e.g., a carboxyl group, a hydroxyl group, a quinone group, a lactone group) evolved from carbon black heated for 7 minutes at 950° C.

Herein, two or more types of carbon blacks as conductive agent may be incorporated. And these carbon blacks may differ in conductivity. Specifically, carbon blacks differing in degree of oxidation treatment or physical properties, such as DBP oil absorption value and specific surface area determined by a BET method utilizing nitrogen adsorption, are used. When two or more types of carbon blacks differing in conductivity as mentioned above are added, the surface resistivity can be controlled, e.g., by adding carbon black developing high conductivity first, and then adding carbon black having low conductivity. When two or more types of carbon blacks are incorporated, the mixing degree and dispersion degree of them can be enhanced by using carbon black adjusted to pH 5.0 or below by oxidation treatment as at least one type of them.

Examples of available acidic carbon black include Printex 150T (pH=4.5, volatile component content: 10.0 mass %) produced by Degussa AG, Special Black 350 (pH=3.5, volatile component content: 2.2 mass %) produced by Degussa AG, Special Black 100 (pH=3.3, volatile component content: 2.2 masse) produced by Degussa AG, Special Black 250 (pH=3.1, volatile component content: 2.0 mass %) produced by Degussa AG, Special Black 5 (pH=3.0, volatile component content: 15.0 mass %) produced by Degussa AG, Special Black 4 (pH=3.0, volatile component content: 14.0 mass %) produced by Degussa AG, Special Black 4A (pH=3.0, volatile component content: 14.0 mass %) produced by Degussa AG, Special Black 550 (pH=2.8, volatile component content: 2.5 mass %) produced by Degussa AG, Special Black 6 (pH=2.5, volatile component content: 18.0 masse) produced by Degussa AG, Color Black FW200 (pH=2.5, volatile component content: 20.0 mass %) produced by Degussa AG, Color Black FW2 (pH=2.5, volatile component content: 16.5 mass %) produced by Degussa AG, Color Black FW2V (pH=2.5, volatile component content: 16.5 mass %) produced by Degussa AG, MONARCH 1000 (pH=2.5, volatile component content: 9.5 mass %) produced by Cabot Corporation, MONARCH 1300 (pH=2.5, volatile component content: 9.5 mass %) produced by Cabot Corporation, MONARCH 1400 (pH=2.5, volatile component content: 9.0 mass %) produced by Cabot Corporation, MOGUL-L (pH=2.5, volatile component content: 5.0 mass %) produced by Cabot Corporation, and REGAL 400R (pH=4.0, volatile component content: 3.5 mass %).

Acidic carbon black has, as mentioned above, high dispersibility in resin compositions through effects of oxygen-containing functional groups present on the surface, compared with general carbon black, so it may be added as conductive fine powder in an increased amount. This increase in content of carbon black in the semiconductive belt makes it possible to fully achieve the effects produced by use of oxidation-treated carbon black, such as reduction of in-plane variations in electric resistance values.

The acidic carbon black may have its content in a base material in a range of, e.g., 10 to 30 mass %, because this range permits achievement of acidic carbon black's effects including reduction of in-plane variations in surface resistivity of the semiconductive belt. When the content of acidic carbon black in the base material is lower than 10 mass %, uniformity of electric resistance is reduced and in-plane unevenness of surface resistivity and electric field dependence become great in some cases. On the other hand, when the content of acidic carbon black in the base material is increased beyond 30 mass %, it sometimes becomes difficult to obtain the desired resistance value. Further, it is suitable to include the acidic carbon black in the range of 18 to 30 mass %. When the acidic carbon black has its content in a range of 18 to 30 mass %, the effects thereof can be achieved to the maximum, and in-plane unevenness of surface resistivity and electric-field dependence can be markedly improved.

When color generation information is given to the semiconductive belt in a state of bearing on the surface a toner image or a recording medium to which toner is transferred, it is hard to allow the light for giving the color generation information to reach to lower part of the toner image transferred in a multilayer state, so insufficient color generation may result, and cases may occur where colors in the image having undergone color generation sometimes differ from the intended ones.

Therefore, the peripheral side of semiconductive belt surface may be designed to reflect light emitted from the light source of a color-generation information giving device 21 and allow the reflected light to strike the toner image again. Specifically, the reflectivity of the semiconductive belt on the peripheral side may be adjusted to a range of 75% to 99%, preferably 80% to 99%, far preferably 85% to 99%.

Figure 6:
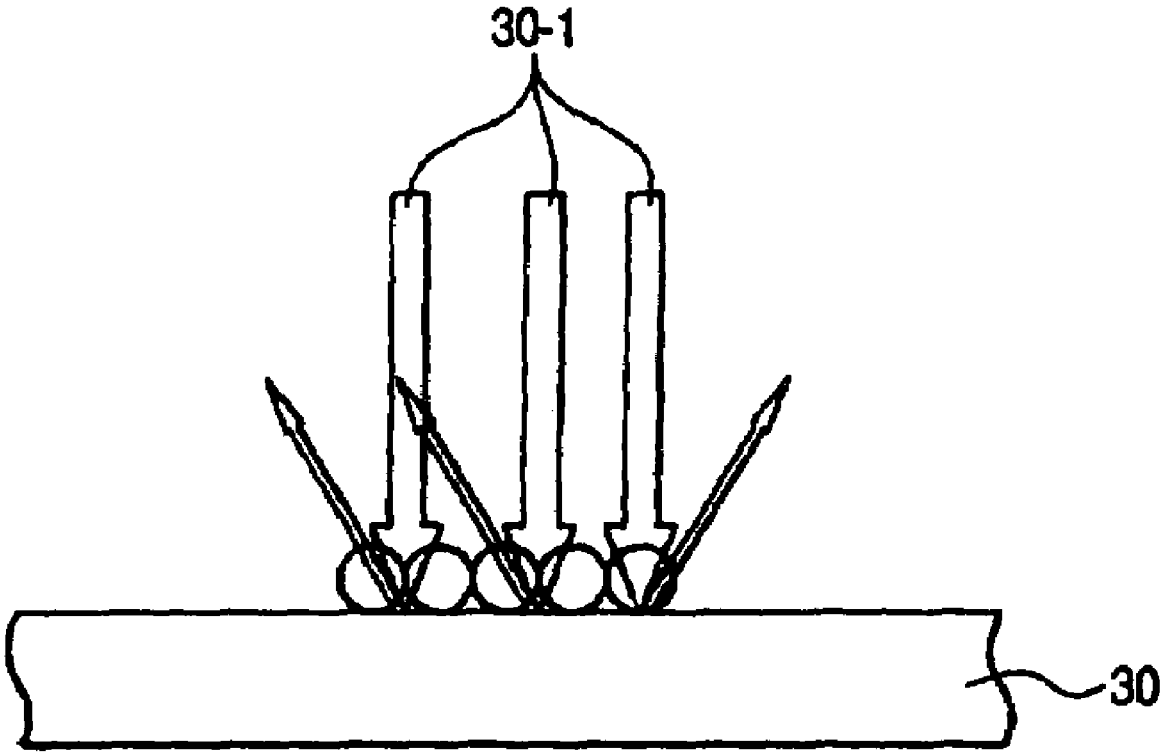
FIG. 6 is a schematic diagram showing a state that light exposure for giving color-generation information is carried out on a semiconductive belt (an intermediate transfer medium, a transportation belt for transfer)

By application of a semiconductive belt having its reflectivity in the foregoing range, as shown in FIG. 6, the toner image T borne by the surface of the semiconductive belt is exposed to exposure light 30-1 for giving color generation information, the exposure light 30-1 reaching to the semiconductive belt 30 via the first toner image T is reflected by the semiconductive belt surface, and the light thus reflected can struck the toner image T again. Accordingly, not only exposure enough to give color generation information can be provided to the toner image T and energy efficiency can be enhanced, but also sufficient color generation of toner can be achieved and the intended colors can be fulfilled in the image obtained. Likewise, needless to say, the intended colors can be fulfilled also in the case of bearing a toner image T-transferred recording medium on the semiconductive belt 30 by designing the recording medium to transmit the exposure light or the reflected light.

Herein, the reflectivity is expressed in proportion of the amount of reflected light, with the amount of light reflected from the magnesium oxide standard white plate (white) being taken as 100 and the amount of light reflected from black color being taken as 0. By means of a spectral radiation illuminometer URE-30 made by Ushio Inc., light with each of different wavelengths (405 nm, 535 nm and 657 nm) is irradiated at an incident angle of 30 degrees, the amount of the light reflected is measured, and the proportion of the amount of the reflected light to the amount of the incident light is determined. By averaging these proportions determined, the reflectivity is calculated.

In order to obtain a semiconductive belt having its reflectivity in the foregoing range, a white conductive agent may be mixed in a base material itself when the belt is made up of the base material alone, or in a surface layer when the belt is made up of a base material and the surface layer.

Examples of a white pigment usable for the foregoing purpose include aluminum-doped zinc oxide (e.g., 23-K (volume average particle size: 4 to 7 μm), produced by Hakusui Tech Co., Ltd.; Pazet CK (volume average particle size: 2 to 5 μm), produced by Hakusui Tech Co., Ltd.; Pazet AK (volume average particle size: 10 to 20 μm), produced by Hakusui Tech Co., Ltd.; Pazet AB (volume average particle size: 10 to 20 μm), produced by Hakusui Tech Co., Ltd.), gallium-doped zinc oxide (e.g., Pazet GK (volume average particle size: 2 to 6 μm), produced by Hakusui Tech Co., Ltd.), and single-crystal zinc oxide (Panatetra, trade name, a product of Matsushita Electric Industrial Co., Ltd., shape: shape like a tetrapod, fiber length: 2 to 50 μm, fiber diameter: 0.2 to 3 μm).

Next other characteristics of a semiconductive belt are described.

When the semiconductive belt is used as an intermediate transfer belt (intermediate transfer medium), the surface resistivity of the semiconductive belt may lie in a range of $1\times10^{10}$ to $1\times10^{14}\Omega/\square$, preferably $1\times10^{11}$ to $1\times10^{13}\Omega/\square$. When the surface resistivity is higher than $1\times10^{14}\Omega/\square$, separation discharge tends to occur in a post-nip region where the photoconductor for primary transfer (latent-image carrier) is separated from the intermediate transfer medium, so defects in image quality, such that images are cleared to white spots or streaks in the discharged area, are caused in some cases. On the other hand, when the surface resistivity is lower than $1\times10^{10}\Omega/\square$, the electric-field strength in the pre-nip region is increased and gap discharge tends to occur in the pre-nip region, so sometimes deterioration in graininess as an image quality is caused. Therefore, adjustment of the surface resistivity to the foregoing range makes it possible to prevent phenomena that images are cleared to white spots or streaks by discharge occurring in the high surface-resistivity case and image quality suffers deterioration in the low surface-resistivity case.

Figure 7A:
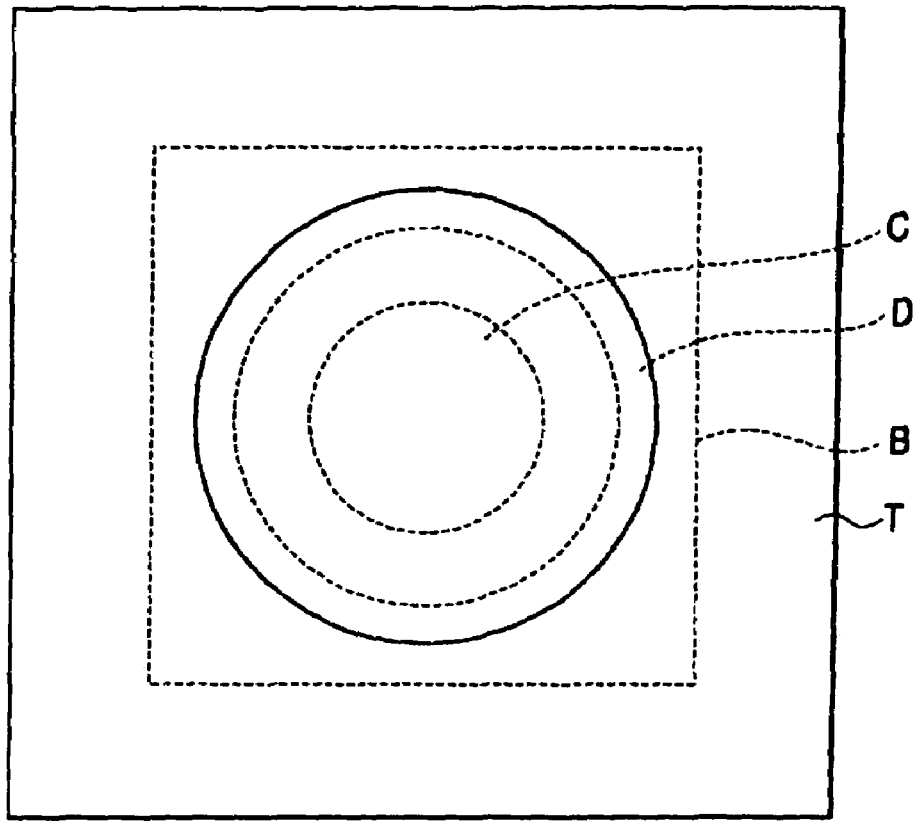
FIG. 7 shows a schematic plan (A) and a schematic cross section (B) of an example of a circular electrode for measurement of surface resistivity.
Figure 7B:
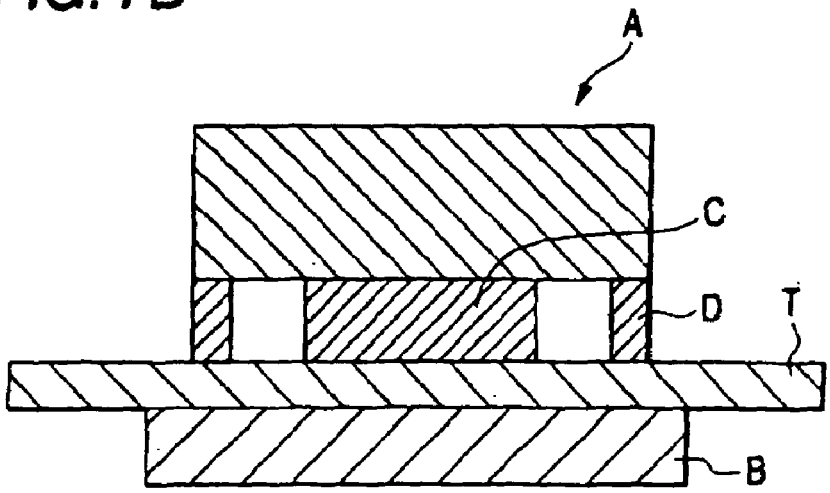

The surface resistivity can be measured using a circular electrode (e.g., HR probe of Hirester IP made by Mitsubishi Petrochemical Co., Ltd.) in accordance with JIS K6991. A method of measuring the surface resistivity is illustrated by reference to FIG. 7. FIG. 7 shows a schematic plan (A) and a schematic cross section (B) of an example of a circular electrode for measurement of surface resistivity. The circular electrode shown in FIG. 7 is provided with a primary voltage application electrode A and a plate insulator B. The primary voltage application electrode A is equipped with a columnar electrode part C and a cylindrical ring electrode part D which has an inside diameter greater than the outside diameter of the columnar electrode part C and circles the columnar electrode part C while leaving a predetermined clearance. An intermediate transfer medium T is sandwiched in between the plate insulator B and the combination of columnar electrode part C and ring electrode part D in the primary voltage application electrode A, and the amount of current I (A) passing through this probe when a voltage V (V) is applied between the columnar electrode part C and the ring electrode part D in the primary voltage application electrode A is measured. The surface resistivity ρs (Ω/□) of intermediate transfer medium T on the transfer side can be calculated by the following relation. Specifically, the surface resistivity is determined from the current value measured after a 10 seconds' lapse from voltage application of 100 V. In the following relation (5), d (mm) stands for the outside diameter of the columnar electrode part C and D (mm) the inside diameter of the ring electrode part D.

$$\rho s=\pi\times(D+d)/(D-d)\times(V/I) \quad (5)$$

(Volume Resistivity)

When the semiconductive belt as mentioned above is used as an intermediate transfer medium, it may have its volume resistivity in a range of $1\times10^{8}$ to $1\times10^{13}$ Ωcm, preferably $1\times10^{9}$ to $1\times10^{12}$ Ωcm. When the volume resistivity is lower than $1\times10^{8}$ Ωcm, the action of an electrostatic force on holding the electric charge of unfixed toner image transferred to the intermediate transfer medium from the latent-image carrier becomes weak, so the toner is scattered around the image (blurred) by electrostatic repulsive force between toner particles and fringe-field force in the vicinity of image edge, sometimes resulting in formation of high-noise image. On the other hand, when the volume resistivity is higher than $1\times10^{13}$ Ωcm, charge holding force becomes great, so the intermediate transfer medium surface is charged by transfer field in the first transfer and sometimes requires a neutralization mechanism. Therefore, the toner-scattering problem and the neutralization mechanism requirement problem can be solved by adjusting the volume resistivity to the forgoing range.

Figure 8A:
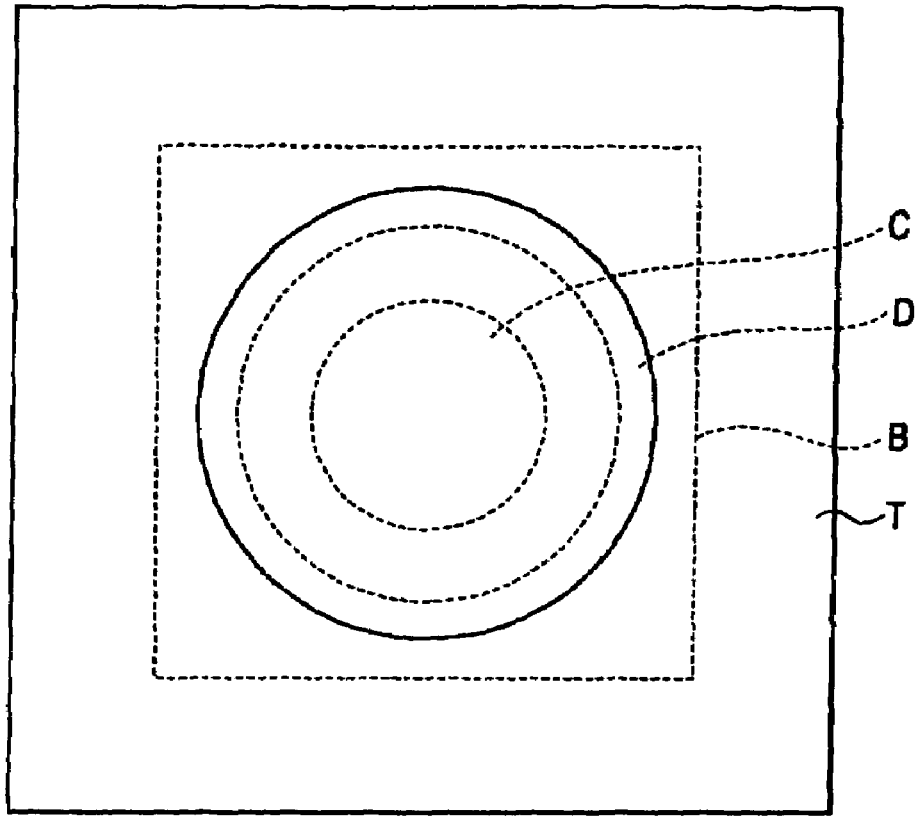
FIG. 8 shows a schematic plan (A) and a schematic cross section (B) of an example of a circular electrode for measurement of volume resistivity.
Figure 8B:
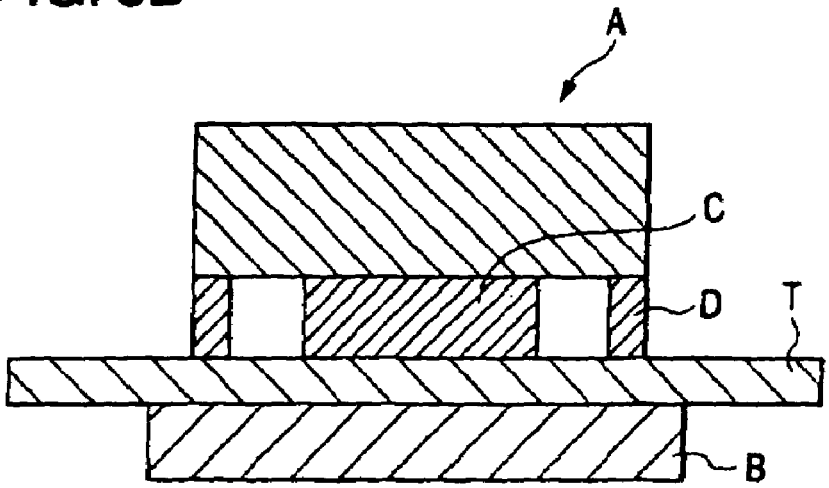

The volume resistivity can be measured using a circular electrode (e.g., HR probe of Hirester IP made by Mitsubishi Petrochemical Co., Ltd.) in accordance with JIS K6991. A method of measuring the volume resistivity is illustrated by reference to FIG. 8. FIG. 8 shows a schematic plan (A) and a schematic cross section (B) of an example of a circular electrode for measurement of volume resistivity. The circular electrode shown in FIG. 8 is provided with a primary voltage application electrode A' and a secondary voltage application electrode B'. The primary voltage application electrode A' is equipped with a columnar electrode part C' and a cylindrical ring electrode part D' which has an inside diameter greater than the outside diameter of the columnar electrode part C' and circles the columnar electrode part C' while leaving a predetermined clearance. An intermediate transfer medium T is sandwiched in between the secondary voltage application electrode B' and the combination of columnar electrode part C' and ring electrode part D' in the primary voltage application electrode A', and the amount of current I (A) passing through this probe when a voltage V (V) is applied between the columnar electrode part C' and the secondary voltage application electrode B' in the primary voltage application electrode A'. is measured. The volume resistivity ρv (Ωcm) of intermediate transfer medium T can be calculated by the following relation. Specifically, the volume resistivity is determined from the current value measured after a 30 seconds' lapse from voltage application of 100 V. In the following relation, t stands for the thickness of the intermediate transfer medium T.

Relation: $\rho v=19.6\times(V/I)\times t$

When the semiconductive belt is used as the transport-to-transfer belt, it may have its volume resistivity in a range of $1\times10^{6}$ to $1\times10^{12}$ Ωcm. When the volume resistivity is lower than $1\times10^{6}$ Ωcm, there sometimes occur scattering of toner around the image; while, when the volume resistivity is higher than $1\times10^{12}$ Ωcm, the electric field required for transfer becomes great, so sometimes the burden on a power supply for voltage application to the belt becomes heavy.

The semiconductive belt may have its thermal expansion coefficient in a range of 0 to 150 PPM/° C., preferably 0 to 100 PPM/° C., far preferably 0 to 50 PPM/° C. When the thermal expansion coefficient is higher than the above range, the amount of change in belt length becomes large within the operating temperature range of the image forming apparatus, so there sometimes occur out-of-resister colors.

Herein, the thermal expansion coefficient is determined by using a thermal analyzer TMA-50 made by Shimadzu Corporation under conditions that and a sample length of 10 mm is taken as base length and the amount of change in base length is measured while raising temperature at a rate of 10° C./min.

The semiconductive belt may have, on the peripheral side, its ten-point-average surface roughness Rzjis in a range of 1.5 to 9.0 μm, preferably 3 to 8 μm, far preferably 4 to 7 μm.

When the ten-point-average surface roughness Rz is below 1.5 μm, there is apprehension that the semiconductive belt is attached firmly to a contact member; while, when the ten-point-average surface roughness Rz is above 9.0 μm, toner and paper dust tends to accumulate on these asperities and this roughness causes microscopic discharge unevenness. Therefore, cases sometimes occur where uniform transfer capability and image quality are reduced with the elapse of time. Additionally, the term "ten-point-average surface roughness Rz" used herein signifies the surface roughness defined in JIS B0601 (1994).

Herein, the ten-point-average surface roughness Rz is a value determined using a contact-type surface roughness measuring instrument (SURFCOM 570A, made by Tokyo Seimitsu Co., Ltd.) in a 23° C.-55RH % environment. When profile scans are given to a semiconductive belt, the scanning length is adjusted to 2.5 mm and a contact stylus having a diamond tip (5 μm R, 90° cone) is used. In this way, measurement of ten-point-average surface roughness is repeated three times at different positions, and the average of these measurement values is calculated and defined as Rz of the semiconductive belt.

As to the intermediate transfer medium, an intermediate transfer drum is usable, and the base material thereof may be a cylindrical material formed, e.g., from aluminum, stainless steel (SUS) or copper. On this cylindrical base material, if needed, an elastic layer (made up of the resinous material or elastic material as used for the foregoing base material) is coated, and further a surface layer is formed thereon. In this way, the intermediate transfer medium can be made.

The intermediate transfer drum may have the same properties as the semiconductive belt. Specifically, the intermediate transfer drum may have the reflectivity as specified above, for example, and may contain a white pigment at least in a layer constituting its surface layer.

Now, the toner used in the image forming apparatus according to the exemplary embodiments is described.

The toner, as mentioned hereinbefore, is a toner that is controlled to retain a color-generation state or a non-color-generation state by being given color-generation information by means of light. The expression "being given color-generation information by means of light" and "retain a color-generation state or a non-color-generation state" used herein also have the same meanings as mentioned hereinbefore.

Various types of toner are known as the toner having the foregoing function. Among them, the toner disclosed in JP-A-2003-330228 cited hereinbefore, for example, is made up of particles which each contain plural microcapsules having capsule walls changing their individual substance permeability by outside stimulation in toner resin in a mixed and dispersed state, and each of these particles contains one (dye precursor of each color) of two reactive substances causing color generation reaction when mixed with each other in each microcapsule and the other reactive substance (developer) in the toner resin outside the microcapsule.

Such toner uses as the capsule wall a photo-isomerizable substance that increases in substance permeability when exposed to light of a specific wavelength. And, by utilizing this cis-trans transition, the two kinds of reactive substances present in and around the capsules can react with each other when they are irradiated with light or ultrasonic waves are applied thereto, thereby causing color generation.

Accordingly, the microcapsules cannot be incorporated in such toner in quantities, and sometimes they are unevenly distributed. As a result, there may be cases where the microcapsules have insufficient photoreception.

Therefore, the exemplary embodiments according to the aspect of the invention may use toner that contains first and second components, which are present in an isolated condition and can generate color when allowed to react with each other, and a light-curable composition in which either the first component or the second component is incorporated, and can perform its color-generation control through retention of the light-curable composition in a cured or uncured state by being given color-generation information by means of light (hereinafter referred to as "F toner" in some cases).

Next, a color-generation mechanism and a simple structure of the F toner are described below.

As described below, the F toner has in a binder resin at least one continuous area capable of generating one specific color (or capable of retaining a non-color-generation state) when color-generation information is given by means of light, which is referred to as color generation area.

FIG. 9 is a diagrammatic illustration showing a color generation mechanism of toner, and (A) is a schematic cross section of one color generation area and (B) is an enlarged view of the color generation area.

Figure 9A:
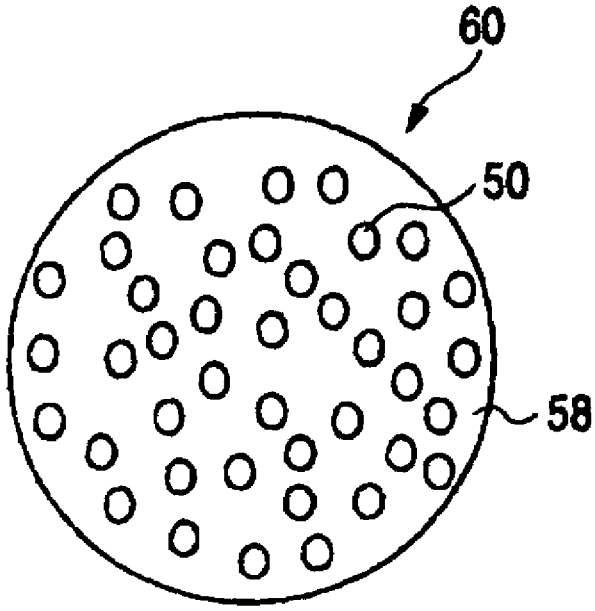
FIG. 9 is a diagrammatic illustration showing a color generation mechanism of toner, and (A) demonstrates a color generation area and (B) is an enlarged view thereof.
Figure 9B:
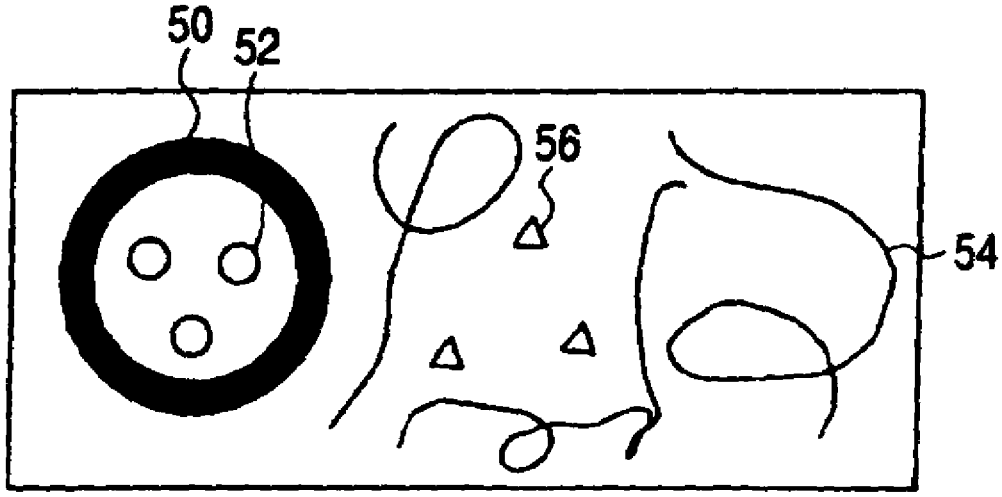

As shown in FIG. 9(A), the color generation area 60 is made up of color-formable microcapsules 50 each containing a color former capable of forming each individual color and a composition 58 surrounding them. As shown in FIG. 9(B), the composition 58 contains a polymerizable functional group-containing developer monomer 54 (second component) capable of developing a color by being brought into proximity to or contact with the color former 52 (first component) contained in each microcapsule 50 and a photopolymerization initiator 56.

In the color generation area 60 constituting each toner particle, the color former 52 encapsulated in the color-forming microcapsule 50 may be a triaryl-containing leuco compound outstanding for hue brightness of the color developed. The developer monomer 54 for developing color of such a leuco compound (electron donor) may be an electron-accepting compound. As the electron-accepting compound, phenol compounds are generally used, and the developer monomer may be chosen appropriately from developers currently used in heat-sensitive paper and pressure-sensitive paper. By acid-base reaction between such electron-donating color former 52 and electron-accepting developer monomer 54, the color former can form its color.

The photopolymerization initiator 56 used herein may be a spectral sensitizing dye which is sensitized by visible light and produces a polymerizing radical functioning as a trigger for polymerizing the developer monomer 54. Further, a reaction accelerator for the photopolymerization initiator 56 may be used so that polymerization reaction of the developer monomer 54 proceeds to a satisfactory degree in response to exposure, e.g., to three primary colors such as R, G and B colors. For instance, polymerization can be initiated by using an ionic complex constituted of an exposure light-absorbing spectral sensitizing dye (cation) and a boron compound (anion) and producing polymerizing radical through electron transfer to the boron compound from the spectral sensitizing dye photo-excited by light exposure.

By combination of those components, color recording sensitivity of the order of 0.1 to 0.2 $mJ/cm^2$ can be achieved in the light-sensitive color generation area 60.

Depending on whether or not the light irradiation for color-generation information is given to each color generation area 60 having the foregoing makeup, some color generation area 60 comes to have a polymerized developer compound, and the other has a developer monomer 54 remaining unpolymerized. In the color generation area 60 having a developer monomer 54 remaining unpolymerized in the subsequent process of color generation with heat, the developer monomer 54 migrates by heat, passes through a hole in the capsule wall of a color-forming microcapsule 50 and dispersed into the color-forming microcapsule. Since the color former 52 is basic and the developer monomer 54 is acidic as mentioned above, the developer monomer 54 dispersed into the microcapsule 50 can make the color former 52 develop its color through acid-base reaction.

On the other hand, the developer compound formed by polymerization reaction cannot pass through a hole in the capsule wall of a microcapsule 50 in the subsequent step of color development by heating because of its bulkiness from polymerization, so it cannot react with the color former 52 in the color-forming microcapsule and fails to cause color development. Accordingly, the color-forming microcapsule 50 remains colorless. In other words, the color generation area 60 irradiated with light of a specified wavelength are present without undergoing color development.

At an appropriate stage after color development, the whole surface is exposed to a white light source again, and thereby not only all residue of unpolymerized developer monomer 54 is polymerized and fixation is effected to provide a stable image, but also the spectral sensitizing dye remaining is decomposed and the ground color is decolored. Additionally, although the tone of a spectral sensitizing dye as a photopolymerization initiator 56 capable of responding to light in the visible region remains to the end as the ground color, this spectral sensitizing dye can be decolored by utilizing a photodecoloring phenomenon of a dye-boron compound complex. More specifically, a polymerizing radical is produced by electron transfer from a photo-excited spectral sensitizing dye to a boron compound, and this radical causes polymerization of the monomer on one side and reacts with excited dye radical on the other to cause color decomposition of the dye and eventually lead to decoloring of the dye.

The color generation area 60 enabling generation of different colors (e.g., Y, M and C colors) in the foregoing way can be configured so that different color formers are enclosed in one microcapsule in a state that each developer monomer 54 is not interfered with color formers other than its individual target color former 52 (state of isolation from each other), and used in the F toner. And in this F toner, the space other than the microcapsules each containing electron-donating color formers is filled with electron-accepting developers and light-curable compositions, and the color generation area configured in the foregoing way accepts light. Therefore, the light-accepting efficiency per one toner particle is higher by far than that of the toner disclosed in JP-A-2003-330228. Accordingly, the F toner can make full use of the effect of back exposure, compared with other toners.

Further, as mentioned above, the color-generation information giving mechanism is not reversible reaction, and it has a merit of having no restriction as to the time lapsed until color generation begins by heating. As a result, printing can be performed even at low speeds, or can support a wide speed range, and besides, there is a merit that the placement of a fixing device for carrying out color generation by heating has a high degree of flexibility.

Structures that the F toner can have are described below in further detail.

The F toner contains as a material enabling color generation (color-generating material) a first component and a second component which are present in a state of isolation from each other and can generate a color when they are react with each other. In this way, reaction between two kinds of reactive components is utilized for color generation, so color-generation control becomes ease. Incidentally, although the first and second components may be in a colored state before they undergo reaction for color generation, they are substantially colorless substances in most cases.

In order to make the color-generation control easy, two kinds of reactive components capable of generating color when reaction is caused between them are used as a color-generating material. When these reactive components are present in the same matrix where diffusion of substances occurs readily, cases may occur in which color generation spontaneously proceeds during the storage or manufacturing even when color-generation information is not given thereto by means of light.

Therefore, it is required to incorporate the reactive components individually in separate matrices and make mutual diffusion of the reactive components difficult unless color-generation information is given thereto (make them be in a mutually isolated state).

In order to inhibit substance diffusion in a state that color-generation information is not given by means of light and prevent spontaneous color generation during the storage and manufacturing of toner, it is possible to incorporate a first component of two kinds of reactive components in a first matrix and a second component outside the first matrix (second matrix), and provide between the first matrix and the second matrix a wall that has a function of inhibiting substance diffusion between both matrices under normal circumstances but, when the stimulation from the outside such as heat is applied, permitting the substance diffusion according to the type of the stimulation, the intensity of the stimulation and a combination thereof.

For arranging two kinds of reactive components in toner by utilizing such a wall, microcapsules may be used.

In this case, the F toner may arrange first one of two kinds of reaction components inside the microcapsule, and second one outside. Herein, the interior of the microcapsule corresponds to the first matrix and the exterior of the microcapsule corresponds to the second matrix.

The microcapsule has a core part and an outer shell covering the core part, and may be chosen from any of known ones as far as they can inhibit diffusion of a substance into the inside or outside when stimulation like heat is not applied from the outside but, when the stimulation from the outside is applied, permit the diffusion of a substance into the inside or outside according to the type of the stimulation, the intensity of the stimulation and a combination thereof. Incidentally, at least one of the reactive components is incorporated in the core part.

Additionally, though the microcapsule may be a microcapsule permitting diffusion of a substance into the inside or outside when receives stimulation, such as light irradiation or pressure, a heat-responsive microcapsule that permits diffusion of a substance into the inside or outside when subjected to heating treatment (increase in substance-permeability of the outer shell) may be used.

From the viewpoint of inhibiting a drop in developed color density at the time of image formation and a change in color balance of the image left standing under high temperature conditions, it is appropriate that the diffusion of a substance into the inside or outside of a microcapsule occur irreversibly when the microcapsule receives stimulation. Therefore, the outer shell of a microcapsule may have a function of irreversibly increasing its substance-permeability through softening, decomposition, dissolution (blending into a surrounding member) or deformation when receives stimulation such as heat treatment or light irradiation.

Exemplary makeups of the F toner including microcapsules are described below.

Such toner may be made up of first and second components capable of generating color when allowed to react with each other, microcapsules and a light-curable composition in which the second component is dispersed, and three examples of its makeup are described below.

Specifically, the F toner may have a makeup that first and second components capable of generating color when allowed to react with each other, a light-curable composition and microcapsules dispersed in the light-curable composition are constituents, the first component is incorporated in the microcapsules and the second component is present in the light-curable composition (first example), a make up that first and second components capable of generating color when allowed to react with each other and microcapsules in which a light-curable composition is incorporated are constituents, the first component is present on the outside of the microcapsules and the second component is contained in the light-curable composition (second example), or a makeup that first and second components capable of generating color when allowed to react with each other, one kind of microcapsules in which the first component is incorporated and the other kind of microcapsules in which a second-component-dispersed light-curable composition is incorporated are constituents (third example).

Of these three examples, the first example may be used from the viewpoints of the stability of toner before color-generation information is given by means of light and color-generation control. Additionally, although the following detailed description of toner is premised basically on the first example of toner, it is needless to say that the following makeup, materials and preparation method in the first example of toner can also be utilized for or diverted into the second example of toner and the third example of toner.

The F toner using the foregoing heat-responsive microcapsules and a light-curable composition in combination may be either of the following two types.

(1) Toner of the type that the substance diffusion of a second component contained in an uncured light-curable composition is inhibited even when heat treatment is carried out in a condition that the light-curable composition is uncured, while the substance diffusion of the second component contained in the light-curable composition after curing is accelerated when heat treatment is carried out after curing the light-curable composition by irradiation with light for giving color-generation information (hereinafter referred to as "photo-color-generating toner").

(2) Toner of the type that the substance diffusion of a second component contained in an uncured light-curable composition is accelerated when heat treatment is carried out in a condition that the light-curable composition is uncured (or a condition that the second component is not polymerized), while the substance diffusion of the second component contained in the cured light-curable composition is inhibited when heat treatment is carried out after curing the light-curable composition by irradiation with light for giving color-generation information (after the second component is polymerized) (hereinafter referred to as "photo-non-color-generating toner").

A main difference between the photo-color-generating toner and the photo-non-color-generating toner is in materials constituting the light-curable composition. The photo-color-generating toner contains at least the second component (having no photopolymerizing capability) and a photopolymerizable compound in the light-curable composition, while the photo-non-color-generating toner contains in the light-curable composition at least the second component having a photopolymerizable group in its molecule.

Additionally, it is appropriate that the light-curable composition used in each of the photo-color-generating toner and the photo-non-color-generating toner contain a photopolymerization initiator, and various other materials may also be contained therein as required.

The materials usable as the photopolymerizable compound and the second component in the photo-color-generating toner are materials that can interact with each other when the light-curable composition is in an uncured condition to inhibit substance diffusion of the second component in the light-curable composition, and that interact less with each other when the light-curable composition is brought into a cured condition (through polymerization of the photopolymerizable compound) by irradiation with light for giving color-generation information to enable easy substance diffusion of the second component in the light-curable composition.

Accordingly, by carrying out previous irradiation with color-generation information giving light of a wavelength capable of causing cure of the light-curable composition before heat treatment (color generating step), the photo-color-generating toner can be brought into a condition that substance diffusion of the second component contained in the light-curable composition is easy. Therefore, when the heat treatment is carried out, the outer shells of microcapsules are dissolved, and reaction (color generation reaction) comes to occur between the first component in the microcapsules and the second component in the light-curable composition.

Conversely, even when heat treatment is carried out without irradiation with color-generation information giving light of a wavelength capable of causing cure of the light-curable composition, the second component is merely trapped in the photopolymerizable compound, and it cannot be brought into contact with the first component in microcapsules. Thus, the reaction (color generation reaction) does not occur between the first component and the second component.

As described above, it is possible to control the reaction between the first component and the second component (color generation reaction) in the photo-color-generating toner by providing heat treatment in combination with whether or not to carry out the irradiation with color-generation information giving light of a wavelength capable of causing cure of the light-curable composition, resulting in control of color generation of the toner.

In photo-non-color-generating toner, on the other hand, since the second component itself has photopolymerizability, even when light for giving color-generation information is applied, the second component contained in the light-curable composition can keep a state that its substance diffusion is easy so long as the wavelength of the light applied is not a wavelength to cause curing of the light-curable composition. Therefore, when heat treatment is carried out in the foregoing situation, reaction (color generation reaction) occurs between the first component in microcapsules and the second component in the light-curable composition through dissolution of outer shells of the microcapsules.

Conversely, when light having a wavelength to cause curing of the light-curable composition is applied as the light for giving color-generation information before heat treatment, the second component contained in the light-curable composition polymerizes by itself, so the substance diffusion of the second component contained in the light-curable composition becomes difficult. Accordingly, even when heat treatment is carried out, the second component cannot be brought into contact with the first component in the microcapsules, and reaction between the first component and the second component (color generation reaction) does not occur.

As described above, it is possible to control the reaction between the first component and the second component (color generation reaction) in the photo-non-color-generating toner by providing heat treatment in combination with whether or not to carry out the irradiation with color-generation information giving light of a wavelength capable of causing cure of the light-curable composition, resulting in control of color generation of the toner.

As to the aforementioned exemplary makeup of the F toner, a case where the toner contains the light-curable composition and microcapsules dispersed in the light-curable composition is described in more detail.

In this case, the toner may have only one or more than two color generation areas which each contain a light-curable composition and microcapsules dispersed in the light-curable composition. Herein, the foregoing term "color generation area" means a continuous area capable of generating one specific color when receives stimulation from the outside as mentioned above.

When two or more color generation areas are contained in the toner, though only one kind of color generation areas capable of generating the same color may be contained in the toner, two or more kinds of color generation areas capable of generating different colors from one another may be contained in the toner. This is because, although the color generated by one toner particle is limited to one kind in the former case, one toner particle in the latter case can be made to generate two or more kinds of colors.

As an example of two or more kinds of color generation areas wherein colors different from one another are generated, a combination including a yellow-generation area capable of generating a yellow color, a magenta-generation area capable of generating a magenta color and a cyan-generation area capable of generating a cyan color can be given.

In this case, when only one kind among color generation areas generates a color by application of stimulation from the outside, the F toner can generate any of yellow, magenta and cyan colors; while, when any two kinds among color generation areas generate colors, the F toner can generate a color as a combination of the colors generated by these two kinds of color generation areas, so it becomes possible to render a variety of colors by one toner particle.

The control of colors generated in the case where two or more kinds of color generation areas capable of generating colors different from one another are contained in the F toner can be achieved by designing so that not only the kind of the first component, the second component or the combination thereof varies with color generation areas, but also the wavelength of light used for curing a light-curable composition contained in one kind of color generation area differs from that for curing a light-curable composition contained in another kind of color generation area.

More specifically, since the wavelengths of light required for curing the light-curable compositions contained in color generation areas vary from one kind of color generation area to another in the foregoing case, plural kinds of color-generation information giving light differing in wavelength according to the kinds of color generation areas may be used as stimulation for control. In order that the wavelengths of light required for curing the light-curable compositions contained in color generation areas are made to vary from one color generation area to another, photopolymerization initiators responsive to light of different wavelengths may be incorporated in light-curable compositions constituting different kinds of color generation areas, respectively.

When three kinds of color generation areas capable of generating yellow, magenta and cyan colors are contained in the F toner and a material capable of curing in response to any of light with a wavelength of 405 nm, light with a wavelength of 532 nm and light with a wavelength of 657 nm is used as a light-curable composition contained in each individual kind of color generation area, generation of the desired color can be caused in the F toner by properly using color-generation information giving light having any of those three different wavelengths (light of a specified wavelength).

Additionally, the wavelength of color-generation information giving light, through selectable from wavelengths in the visible region, may be chosen from wavelengths in the ultraviolet region.

The F toner may contain a matrix having as a main component the same binding resin as used in usual toner of the type which uses a coloring agent like pigment. In this case, each of two or more kinds of color generation areas may be dispersed in the form of particulate capsules into the matrix (hereinafter, one color generation area in a capsule form is referred to as "a light-and-heat-sensitive capsule" in some cases). Additionally, the matrix may contain a release agent and other additives as in the case of usual toner using a coloring agent like pigment.

The light-and-heat-sensitive capsule has a core part containing a microcapsule and a light-curable composition, and an outer shell covering the core part. This outer shell has no particular restriction so long as it can hold the microcapsule and the light-curable composition in the light-and-heat-sensitive capsule with stability so as not to leak them in the production process of toner as mentioned below and during the storage of toner.

However, in order to prevent a second component from passing through an outer shell of one light-and-heat-sensitive capsule and flowing into a matrix outside the light-and-heat-sensitive capsule and another second component in a light-and-heat-sensitive capsule capable of generating a different color from passing through the outer shell and flowing in during the production process of toner as described hereinafter, the outer shell may contain as main components a binding resin made up of water-insoluble resins and water-insoluble materials including a release agent.

Next, toner constituent materials used in the F toner, and materials and methods usable in making an adjustment to each toner constituent material are described below in more detail.

In the F toner, at least a first component, a second component, microcapsules containing the first component and a light-curable composition containing the second component are used. It is favorable to contain a photopolymerization initiator in the light-curable composition, and other auxiliary agents may also be contained in the light-curable composition. In the interior (core part) of the microcapsules, the first component may be present in a solid state, or it may be present together with a solvent.

In the photo-non-color-generating toner, a electron-donating colorless dye or a diazonium salt compound is used as the first component, and an electron-accepting compound having a photopolymerizable group or a coupler compound having a photopolymerizable group is used as the second component. In the photo-color-generating toner, on the other hand, an electron-donating colorless dye is used as the first component, an electron-accepting compound (which is referred to as "an electron-accepting developer" or "a developer" in some cases) is used as the second component, and a polymerizable compound having an ethylenic unsaturated bond is used as the photopolymerable compound.

In addition to the materials recited above, various materials as included in usual toner using coloring agents, such as a binding resin, a release agent, internal additives and external additives, can be utilized as appropriate. Each of these materials is described below in more detail.

—First Component and Second Component—

The combination of the first component and the second component may be chosen from the following exemplary combinations (a) to (r) (In each of the following combinations, the former is the first component and the latter the second component):

(a) combination of an electron-donating colorless dye and an electron-accepting compound, (b) combination of a diazonium salt compound and a coupling component (which may be referred to as "a coupler compound" hereinafter), (c) combination of a metal salt of organic acid, such as silver behenate or silver stearate, and a reducing agent, such as protocatechinic acid, sprioindane or hydroquinone, (d) combination of an iron salt of long-chain fatty acid, such as ferric stearate or ferric myristate, and a phenol, such as tannic acid, gallic acid or ammonium salicylic acid, (e) combination of a heavy metal salt of organic acid, such as nickel, cobalt, lead, copper, iron, mercury or silver salt of acetic acid, stearic acid or palmitic acid, and a sulfide of alkali metal or alkaline earth metal, such as calcium sulfide, strontium sulfide or potassium sulfide, or a combination of the heavy metal salt of organic acid as recited above and an organic chelating agent such as s-diphenylcarbazide or diphenylcarbazone, (f) combination of a sulfate of heavy metal, such as silver, lead or mercury, or sodium sulfate and a sulfur compound, such as sodium tetrathionate, sodium thiosulfate or thiourea, (g) combination of a ferric salt of fatty acid, such as ferric stearate, and an aromatic polyhydroxy compound, such as 3,4-hydroxytetraphenylmethane, (h) combination of a metal salt of organic acid, such as silver oxalate or mercury oxalate, and an organic polyhydroxy compound, such as polyhydroxy alcohol, glycerin or glycol, (i) combination of a ferric salt of fatty acid, such as ferric pelargonate or ferric laurate, and a thiocesylcarbamide or isothiocesylcarbamide derivative, (j) combination of a lead salt of organic acid, such as lead caproate, lead pelargonate or lead behenate, and a thiourea derivative, such as ethylenethiourea or N-dodecylthiourea, (k) combination of a heavy metal salt of higher fatty acid, such as ferric stearate or copper stearate, and zinc dialkyldithiocarbamate, (l) oxazine dye-forming combination, such as a combination of resorcinol and a nitroso compound, (m) combination of a formazane compound and a reducing agent and/or a metal salt, (n) combination of a protected dye (leuco dye) precursor and a deprotection agent, (o) combination of an oxidized color coupler and an oxidizing agent, (p) combination of a phthalonitrile and a diiminoisoindoline (combination forming a phthalocyanine), (q) combination of an isocyanate and a diiminoisoindoline (combination forming a colored pigment), and (r) combination of a pigment precursor and an acid or a base (combination of forming a pigment).

Of the substances recited above as the first component, substantially colorless electron-donating dyes or diazonium salt compounds are preferable.

Any of known electron-donating colorless dyes can be used as the first component as far as they can develop color by reaction with the second component. Examples of such a colorless dye include a wide variety of compounds, such as phthalide compounds, fluorane compounds, phenothiazine compounds, indolylphthalide compounds, leuco Auramine compounds, Rhodamine lactam compounds, triphenylmethane compounds, triazene compounds, spiropyran compounds, pyridine compounds, pyrazine compounds and fluorene compounds.

The second component usable in the photo-non-color-generating toner may be any of compounds as far as they are substantially colorless compounds each having a photopolymerizing group and a moiety capable of reacting with the first component to develop a color in the same molecule, and have both a function of developing a color by reaction with the first component and a function of polymerizing and curing in response to light, such as electron-accepting compounds having photopolymerizing groups or coupler compounds having photopolymerizing groups.

As the electron-accepting compound having a photopolymerizable group, namely the compound having both an electron-accepting group and a photopolymerizing group in the same molecule, any of compounds can be used so long as they have photopolymerizable groups and can react with an electron-donating colorless dye as one example of the first component to develop a color and can be cured by photopolymerization.

Examples of an electron-accepting developer usable as the second component in the case of photo-color-generating toner include phenol derivatives, sulfur-containing phenol derivatives, organic carboxylic acid derivatives (e.g., salicylic acid, stearic acid, resorcylic acid) and metal salts thereof, sulfonic acid derivatives, urea or thiourea derivatives, acid clay, bentonite, novolak resins, metal-treated novolak resins, and metal complexes.

Further, a polymerizable compound having an ethylenic unsaturated bond can be used as a photopolymerizable compound in the photo-color-generating toner. This photopolymerizable compound is a polymerizable compound having at least one ethylenic unsaturated double bond in its molecule, such as acrylic acid or a salt thereof, an acrylic acid ester or an acrylamide.

Next, the photopolymerization initiator is described. The photopolymerization initiator can produce radicals when irradiated with color-generation information giving light, and not only can cause polymerization reaction in a light-curable composition but also can accelerate the reaction. This polymerization reaction cures the light-curable composition.

The photopolymerization initiator can be chosen appropriately from known ones. Specifically, it may be a combination including a spectral sensitizing compound having its maximum absorption wavelength in a range of 300 to 1,000 nm and a compound capable of interacting with the spectral sensitizing compound.

However, when the compound capable of interacting with the spectral sensitizing compound is a compound having in its structure both a dye moiety having its maximum absorption wavelength in the range of 300 to 1,000 nm and a borate moiety, it may be omitted to use the spectral sensitizing compound.

As the compound capable of interacting with the spectral sensitizing compound, one or more than one compound chosen appropriately from known compounds capable of starting photopolymerization reaction with a photopolymerizable group in the second component can be used.

The presence of this compound together with the spectral sensitizing compound can enhance responsivity to irradiation light in the wavelength region of spectral absorption and enables efficient production of radicals. As a result, high sensitivity can be achieved, and radical production can be controlled by using any of light sources with ranges from ultraviolet through infrared.

Examples of the foregoing "compound capable of interacting with the spectral sensitizing compound" include organic borate compounds, benzoin ethers, s-triazine derivatives having trihalo-substituted methyl groups, organic peroxides and azinium salt compounds. Of these compounds, organic borate compounds are preferable. The combined use of such a "compound capable of interacting with the spectral sensitizing compound" and the spectral sensitizing compound makes it possible to produce radicals locally and efficiently in the exposed areas alone to result in achievement of high sensitivity.

To the light-curable composition, auxiliary agents including an oxygen scavenger, a reducing agent like a chain transfer agent of an active hydrogen donor and other compounds capable of accelerating polymerization in a chain transfer state can further be added for the purpose of accelerating the polymerization reaction, too.

Examples of a compound usable as the oxygen scavenger include phosphine, phosphonate, phosphite, Ag(I) salts, and other compounds easily oxidized by oxygen, such as N-phenylglycine, trimethylbarbituric acid, N,N-dimethyl-2,6-diisopropylaniline and N,N,N-2,4,6-pentamethylaniline acid. Further, thiols, thioketones, trihalomethyl compounds, lophine dimer compounds, iodonium salts, sulfonium salts, azinium salts, organic peroxides and azides are also useful as polymerization accelerators.

When the first component, such as an electron-donating colorless dye or a diazonium salt compound, is used in the F toner, it is microencapsulated.

As a microencapsulating method, any of known methods can be used. Examples of such a method include the method of utilizing coacervation of hydrophilic wall-forming materials as disclosed in U.S. Pat. Nos. 2,800,457 and 2,800,458; the interfacial polymerization methods disclosed in U.S. Pat. No. 3,287,154, U.K. Patent No. 990,443, JP-B-38-19574, JP-B-42-446 and JP-B-42-771; the methods of utilizing polymer precipitation as disclosed in U.S. Pat. Nos. 3,418,250 and 3,660,304; the method of using an isocyanate polyol wall material as disclosed in U.S. Pat. No. 3,796,669; the method of using an isocyanate wall material as disclosed in U.S. Pat. No. 3,914,511; the methods of using wall forming materials of urea-formaldehyde and urea-formaldehyde-resorcinol types as disclosed in U.S. Pat. Nos. 4,001,140, 4,087,376 and 4,089,802; the methods of using wall forming materials, such as melamine-formaldehyde resin and hydroxypropyl cellulose, as disclosed in U.S. Pat. No. 4,025,455; the in situ method of using polymerization of monomers as disclosed in JP-B-36-9168 and JP-A-51-9079; the electrolytic dispersion cooling methods disclosed in U.K. Patent Nos. 952,807 and 965,074; the spray drying methods disclosed in U.S. Pat. No. 3,111,407 and U.K. Patent No. 930,422; and the methods disclosed in JP-A-4-101885 and JP-A-9-263057.

A material usable for a microcapsule wall is added to the interior and/or exterior of oil droplets. Examples of such a microcapsule wall material include polyurethane, polyurea, polyamide, polyester, polycarbonate, urea-formaldehyde resin, melamine resin, polystyrene, styrene-methacrylate copolymer and styrene-acrylate copolymer. Of these materials, polyurethane, polyurea, polyamide, polyester and polycarbonate are preferable, and polyurethane and polyurea are more preferable. Those high-molecular substances may also be used as combinations of two or more thereof.

The volume-average particle size of microcapsules may be adjusted to be within the range of 0.1 to 3.0 μm, preferably 0.3 to 1.0 μm.

The light-and-heat-sensitive capsules may contain a binder, and this is ditto for the case of toner having one color generation area.

Examples of a binder usable therein include the same binders as used for emulsified dispersion of the light-curable composition; water-soluble high polymers usable for capsulation of the first reactive substance; solvent-soluble high polymers, such as polystyrene, polyvinyl formal, polyvinyl butyral, acrylic resins including polymethyl acrylate, polybutyl acrylate, polymethyl methacrylate, polybutyl methacrylate and copolymers of constituents monomers of these polymers, phenol resins, styrene-butadiene resins, ethyl cellulose, epoxy resins and urethane resins; and polymeric latexes of these resins. Of these high polymers, gelatin and polyvinyl alcohol are preferable. In addition, the binding resins mentioned below may be used as the binder.

In the F toner, a binding resin as used in usual toner can be used. In the toner having a structure that light-and-heat-sensitive capsules are dispersed in a matrix, for example, the binding resin can be utilized as a main component of the matrix, or a material constituting the outer wall of light-and-heat-sensitive capsules, but not limited to such utilization.

There is no particular restriction as to the binding resin, but any of known crystalline or non-crystalline resin materials can be used as the binding resin. For imparting low-temperature fixability, crystalline polyester resin having the property of melting sharply is useful. As amorphous high polymers (non-crystalline resins), known resin materials, such as styrene-acrylic resin and polyester resin, can be used. Of these resins, non-crystalline polyester resin is preferable.

In addition to the ingredients as recited above, the F toner may contain other ingredients. There are no particular restrictions as to the other ingredients, but they can be chosen as appropriate according to the intended purposes. Examples thereof include known various additives used in usual toner, such as a release agent, inorganic fine particles, organic fine particles and an electrification controller.

Next, the method of making the F toner is briefly described.

The F toner may be made utilizing a known wet process, such as a flocculation union method. The wet process is suitable for making the toner containing the first component and the second component, which react with each other to generate a color, a light-curable composition and microcapsules dispersed in the light-curable composition, and having a structure that the first component is incorporated in the microcapsules and the second component is included in the light-curable composition.

Additionally, the microcapsules used for the toner having the foregoing structure are favorably heat-responsive microcapsules, but they may be microcapsules responsive to light or another stimulation.

In toner making, the use of a flocculation union method as one of wet processes, though any of known wet processes can be used, is appropriate on the ground that it can reduce the highest process temperature to a lower level and permits easy making of toners having various structures.

Additionally, since it has a high content of light-curable composition whose main component is a low-molecular component, the toner having the foregoing structure is apt to be insufficient in strength of particles obtained in the granulation process of toner, compared with usual toner containing pigment and binding resin as main components. In this respect also, it is suitable to utilize the flocculation union process because this process does not require high shear strength.

In general, the flocculation union process includes, after preparation of dispersions of various materials to constitute toner, a flocculation step in which flocculated particles are formed in a raw material dispersion as a mixture of two or more of the dispersions prepared in advance and a fusion step in which flocculated particles formed in the raw material dispersion are fused, and further a deposition step in which a component for forming a covering layer is deposited on the surfaces of flocculated particles to form the covering layer (covering-layer formation step) is performed between the flocculation step and the fusion step, if needed.

In making the F toner also, though the kinds and combinations of various dispersions used for the raw material are different, a deposition step can be performed as appropriate in addition to the flocculation step and the fusion step.

In the case of toner having a structure that light-and-heat-sensitive capsules are dispersed in a resin, for example, a dispersion of one or more kinds of light-and-heat-sensitive capsules capable of generating mutually different colors is prepared by successively undergoing (a1) a first flocculation step in which first flocculated particles are formed in a raw material dispersion including a microcapsule dispersion wherein first-component containing microcapsules are dispersed and a light-curable composition dispersion wherein a second-component containing light-curable composition is dispersed, (b1) a deposition step in which a first resin-particle dispersion wherein resin particles are dispersed is added to the raw material dispersion wherein the first flocculated particles are formed and thereby the resin particles are deposited on the surfaces of the flocculated particles, and (c1) a first fusion step in which the flocculated particles on the surfaces of which the resin particles are deposited are fused by heating the raw material dispersion containing them to form first fused particles (light-and-heat-sensitive capsules).

Subsequently thereto, (d1) a second flocculation step in which second flocculated particles are formed in a mixed solution prepared by mixing a second resin-particle dispersion wherein resin particles are dispersed and the foregoing dispersion of one or more kinds of light-and-heat-sensitive capsules and (e1) a second fusion step in which second fused particles are formed by heating the mixed solution containing the second flocculated particles are performed in succession. Thus, toner having a light-and-heat-sensitive capsule dispersion structure can be obtained.

Incidentally, it may be adapted to use two or more kinds of light-and-heat-sensitive capsule dispersions in the second flocculation step. In addition, the light-and-heat-sensitive capsules obtained by undergoing the steps (a1) to (c1) may be utilized as toner as they are (namely, toner containing one color generation area alone).

Alternatively, toner containing one color generation area alone may be made by performing, in place of the foregoing deposition step, a first deposition step in which a release agent dispersion wherein a release agent is dispersed is added to the raw material dispersion wherein the first flocculated particles are formed to deposit the release agent on the surfaces of the flocculated particles, and then a second deposition step in which the first resin-particle dispersion wherein resin particles are dispersed is added to the raw material dispersion having undergone the first deposition step to deposit the resin particles on the release agent-deposited surfaces of flocculated particles.

The volume-average particle size of F toner usable in the invention has no particular limitation, but it can be adjusted appropriately according to the structure of the toner and the kinds and number of color generation areas in the toner.

However, as far as two to four kinds of color generation areas capable of generating different colors are contained in the toner (e.g., in a case of the toner containing three kinds of color generation areas capable of generating yellow, cyan and magenta colors, respectively), the volume-average particle size according to each toner structure may be within the following range.

Specifically, the volume-average particle size of toner may be within the range of 5 to 40 μm, preferably 10 to 20 μm, when the toner structure is a light-and-heat-sensitive capsule (color generation area) dispersion structure. In addition, the volume-average particle size of light-and-heat-sensitive capsules contained in the toner with the dispersion structure of light-and-heat-sensitive capsules having the foregoing particle sizes may be within the range of 1 to 5 μm, preferably 1 to 3 μm.

When the volume-average particle size of toner is smaller than 5 μm, the content of a color-generation component in the toner becomes low, so there sometimes occur deterioration in color reproducibility and reduction in image density. On the other hand, when the volume-average particle size of toner is greater than 40 μm, asperities on the image surface becomes great, so there sometimes occurs unevenness of gloss on the image surface or deterioration in image quality.

Although the toner of light-and-heat-sensitive capsule dispersion structure, in which plural light-and-heat-sensitive capsules are dispersed, is apt to increase in particle size, compared with usual small-size toner using a coloring agent (the volume-average particle size of which is of the order of 5 to 10 μm), it may deliver higher-definition images because the resolution of image is determined by the particle size of light-and-heat-sensitive capsules, and not determined by the particle size of toner. In addition, the toner of the capsule dispersion structure may has excellent powder flowability, so it may ensure sufficient flowability even when external additives are scarce, and besides, it may have improvements in developability and cleanability.

In the case of toner having only one color generation area, on the other hand, reduction of its particle size may be easy as compared with the above case, and the volume-average particle size may be adjusted to the range of 3 to 8 μm, preferably 4 to 7 μm. When the volume-average particle size is smaller than 3 μm, the toner may not have sufficient powder flowability or sufficient durability in some cases because of its too small particle size. When the volume-average particle size is greater than 8 μm, on the other hand, there may be cases where high-definition images cannot be obtained.

In the invention, not only the F toner described above but also any other toners can be used regardless of constituent materials used therein, toner structure and color generation mechanism so long as they can be controlled to retain a color-generation state or non-color-generation state by receiving light irradiation (or by not receiving light irradiation).

The toner usable in the invention may have a volume-average particle size distribution index GSDv of 1.30 or below, and besides, it may have a ratio of the volume-average particle size distribution index GSDv to the number-average particle size distribution index GSDp (GSDv/GSDp) of 0.95 or above.

Further, the volume-average particle size distribution index GSDv may be 1.25 or below, and besides, the ratio of the volume-average particle size distribution index GSDv to the number-average particle size distribution index GSDp (GSDv/GSDp) may be 0.97 or above.

When the volume-average particle size distribution index GSDv is greater than 1.30, resolution of images is sometimes lowered, and when the ratio of the volume-average particle size distribution index GSDv to the number-average particle size distribution index GSDp (GSDv/GSDp) is lower than 0.95, there sometimes occur a drop in chargeability of toner, scatter of toner and fogging to result in image defects.

In the invention, the volume-average particle size of toner, the values of a volume-average particle size distribution index GSDv and a number-average particle size distribution index GSDp are calculated from the following measurement.

The toner particle size distribution measured with a measuring instrument Coulter Multisizer II (made by Beckman Coulter Inc.) is plotted as cumulative distribution against volumes and numbers of individual particles from the small-size side with respect to divided particle size ranges (channels). Therein, the particle sizes corresponding to an accumulation of 16% are defined as the volume-average particle size D16v and the number-average particle size D16p, and the particle sizes corresponding to an accumulation of 50% are defined as the volume-average particle size D50v and the number-average particle size D50p. Likewise, the particle sizes corresponding to an accumulation of 84% are defined as the volume-average particle size D84v and the number-average particle size D84p. Herein, the volume-average particle size distribution index (GSDv) is defined as $(D84v/D16v)^{1/2}$, and the number-average particle size distribution index (GSDp) is defined as $(D84p/D16p)^{1/2}$. By use of these relations, the volume-average particle size distribution index (GSDv) and the number-average particle size distribution index (GSDp) can be calculated.

In addition, the volume-average particle size of the microcapsules and that of the light-and-heat-sensitive capsules can be measured with a laser diffraction particle size distribution analyzer (LA-700, made by Horiba Ltd.).

Further, the toner used in the invention may have its shape factor SF1 represented by the following equation (1) within the range of 110 to 130:

$$SF1=(ML^2/A)\times(\pi/4)\times 100 \quad (1)$$

wherein ML stands for the greatest length (μm) of the toner, and A stands for the projected area ($\mu m^2$) of the toner.

When the shape factor SF1 is smaller than 110, the toner tends to remain on an image carrier surface in the transfer step of image formation and requires elimination of residual toner. And the residual toner tends to impair cleanability when cleaned, e.g., with a blade, and sometimes gives rise to image defects.

On the other hand, when the shape factor SF1 is greater than 130, there are cases where the toner used as a developer is broken by collision with carrier in a development vessel, and thereby fine powder increases and an image carrier surface is contaminated with a release component exposed at the toner surface to cause problems, such as impairment of charging characteristics and fogging traceable to the fine powder.

The shape factor SF1 is measured using an image analyzing system (LUZEX FT, made by Nireco Corporation) in the following manner. First, an optical microscope image of the toner sprayed on a slide is captured in a LUZEX image analyzing system via a video camera, and at least 50 toner particles are examined for their individual greatest lengths (ML) and projected areas (A). Then, the shape factor SF1 of each individual toner particle is calculated from the square of the greatest length and the projected area in accordance with the foregoing formula (1).

<Developer>

The F toner may be used as a one-component developer as it is, but the invention may use the F toner as toner in a two-component developer constituted of toner and carrier.

In respect of formation of color images by use of one kind of developer, the developer may be either (1) a developer of the type which has one kind of the F toner containing two or more kinds of color generation areas which each has the light-curable composition and microcapsules dispersed in the light-curable composition, wherein the two or more kinds of color generation areas contained in the F toner can generate colors different from one another, or (2) a developer of the type which has two or more kinds of toner in a mixed state, which each has one color generation area containing the light-curable composition and microcapsules dispersed in the light-curable composition, wherein the color generation areas of two or more kinds of toner can generate colors different from one another.

For instance, the developer of the former type may contain the F toner having three kinds of color generation areas, and these three kinds of color generation areas may be a yellow generation area capable of generating a yellow color, a magenta generation area capable of generating a magenta color and a cyan generation area capable of generating a cyan color. In the developer of the latter type, on the other hand, yellow generating toner whose color generation area can generate a yellow color, magenta generating toner whose color generation area can generate a magenta color and cyan generating toner whose color generation area can generate a cyan color may be contained in a mixed state.

The carrier usable in the two-component developer may be made up of a core material and a resin covering the core material surface. The core material of carrier has no particular limitations so long as it can meet the foregoing condition, but examples thereof may include magnetic metals, such as iron, steel, nickel and cobalt, alloys of manganese, chromium or a rare earth and these magnetic metals, and magnetic oxides, such as ferrites or magnetite. Of these materials, ferrites, such as alloys of manganese, lithium, strontium or magnesium and ferrites, are preferred in terms of surface quality and resistance of the core material.

On the other hand, the resin for covering the core material surface has no particular restriction so long as it can be used as matrix resin, but it may be chosen as appropriate according to the intended purpose.

In the two-component developer, the mixing ratio (by mass) of the F toner to the carrier (toner:carrier) may be of the order of from 1:100 to 30:100, preferably of the order of from 3:100 to 20:100.

EXEMPLARY EMBODIMENTS

The invention will now be illustrated in more detail by reference to the following exemplary embodiments. However, these exemplary embodiments should not be construed as limiting the scope of the invention in any way. Additionally, in the following exemplary embodiments, all parts and percentages (%) are by mass.

Toner (toner particles) containing developers are prepared in the following manners. Additionally, preparation of light-curable composition dispersions and a series of toner preparation using these dispersions are all carried out in a dark place.

(Toner-1: Preparation of Photo-Non-Color-Generation Toner)

Preparation of Microcapsule Dispersions

—Microcapsule Dispersion (1)—

In 16.9 parts of ethyl acetate, 8.9 parts of an electron-donating colorless dye (1) capable of generating a yellow color is dissolved. Thereto, 20 parts of a capsule wall material (Takenate D-110N, trade name, produced by Takeda Pharmaceutical Company Limited) and 2 parts of a capsule wall material (Millionate MR200, trade name, produced by Nippon Polyurethane Industry Co., Ltd.) are added.

The solution obtained is added to a mixture of 42 parts of 8% phthaloylated gelatin, 14 parts of water and 1.4 parts of a 10% sodium dodecylbenzenesulfonate solution, and emulsified and dispersed at a temperature of 20° C. to prepare an emulsion. Then, 72 parts of a 2.9% aqueous solution of tetraethylenepentamine is added to the emulsion obtained, and heated up to 60° C. with stirring. After a lapse of 2 hours, a microcapsule dispersion (1) containing the electron-donating colorless dye (1) in the core part and having an average particle size of 0.5 μm is obtained.

Additionally, the glass transition temperature of the material constituting the outer shell of microcapsules contained in the microcapsule dispersion (1) (the material produced by reaction between Takenate D-110N and Millionate MR200 under almost the same condition as mentioned above) is 100° C.

—Microcapsule Dispersion (2)—

A microcapsule dispersion (2) is obtained in the same manner as in the case of preparation of the microcapsule dispersion (1), except that an electron-donating colorless dye (2) is used in place of the electron-donating colorless dye (1). The average particle size of microcapsules in this dispersion is 0.5 μm.

—Microcapsule Dispersion (3)—

A microcapsule dispersion (3) is obtained in the same manner as in the case of preparation of the microcapsule dispersion (1), except that an electron-donating colorless dye (3) is used in place of the electron-donating colorless dye (1). The average particle size of microcapsules in this dispersion is 0.5 μm.

Additionally, the chemical formulae of the electron-donating colorless dyes (1) to (3) used in preparing the microcapsule dispersions are shown below.

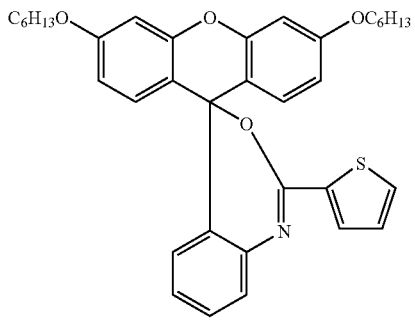

Electron-donating Colorless Dye (1)

-continued

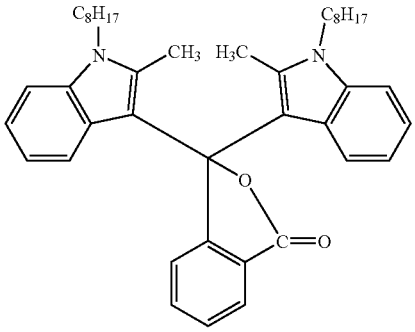

Electron-donating Colorless Dye (2)

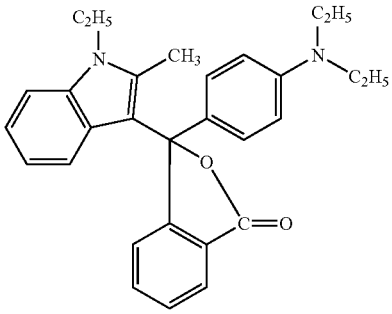

Electron-donating Colorless Dye (3)

Preparation of Light-Curable Composition Dispersions

—Light-curable Composition Dispersion (1)—

In 125.0 parts of isopropyl acetate (solubility in water: about 4.3%), 100.0 parts of a mixture of polymerizable group-containing electron-accepting compounds (1) and (2) (mixing ratio=50:50) and 0.1 parts of a thermal polymerization inhibitor (ALI) are dissolved at 42° C. to prepare a mixed solution I.

To the mixed solution I, 18.0 parts of hexaarylbiimidazole (1) [2,2'-bis(2-chlorophenyl)-4,4',5,5'-tetraphenyl-1,2'-biimidazole], 0.5 parts of a nonionic organic dye and 6.0 parts of an organoboron compound are added. They are dissolved at 42° C. to prepare a mixed solution II.

The mixed solution II is added to a mixture of 300.1 parts of a 8% aqueous gelatin solution and 17.4 parts of a 10% water solution of surfactant (1), and emulsified for 5 minute using a homogenizer (made by Nippon Seiki Co., Ltd.) at the revs of 10,000, and further subjected to solvent removal treatment for 3 hours at 40° C. Thus, a light-curable composition dispersion (1) having a solids content of 30% is obtained.

Additionally, the structural formulae of the polymerizable group-containing electron-accepting compounds (1) and (2) used in preparing the light-curable composition dispersion (1), the thermal polymerization inhibitor (ALI), the hexaarylbiimidazole (1), the surfactant (1), the nonionic organic dye and the organoboron compound are illustrated below.

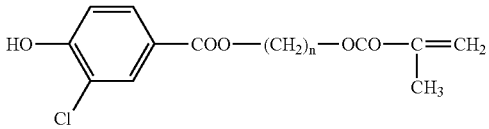

Polymerizable Electron-donating Compounds n = 5 (1)
n = 6 (2)

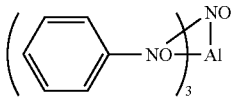

ALI

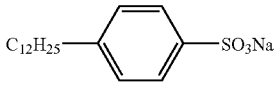

Surfactant (1)

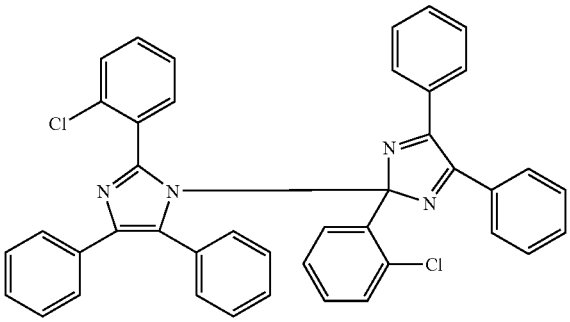

Hexaarylbiimidazole (1)

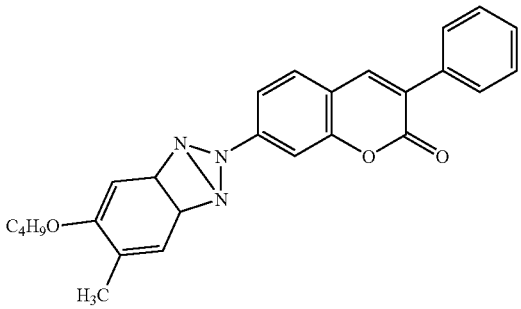

Nonionic Organic Dye

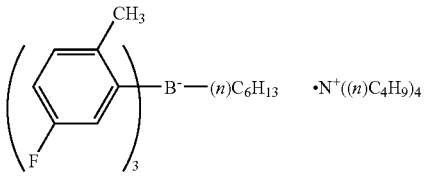

Organoboron Compound

—Light-Curable Composition Dispersion (2)—

To a mixture of 0.6 parts of the following organoboron compound (I), 0.1 parts of the following spectral sensitizing dye-attached boron compound (I), 0.1 parts of the following auxiliary agent (1) aimed at increasing the sensitivity and 3 parts of isopropyl acetate (solubility in water: about 4.3%), 5 parts of the following polymerizable group-containing electron-accepting compound (3) is added.

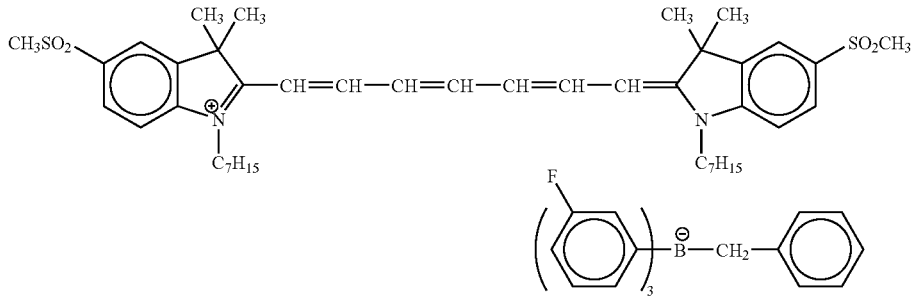

Organoboron Compound (I)

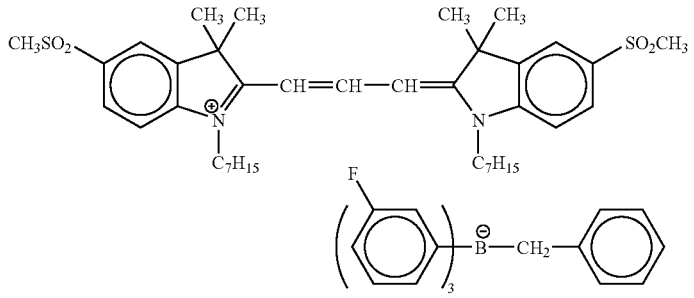

Spectral Sensitizing Dye-attached Boron Compound (I)

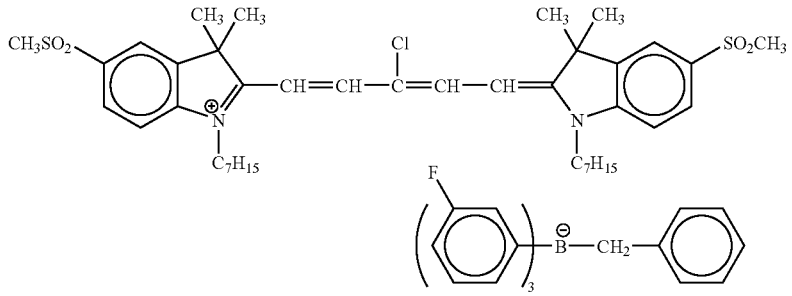

Spectral Sensitizing Dye-attached Boron compound (II)

The solution obtained is added to a mixture of 13 parts of a 13% aqueous gelatin solution, 0.8 parts of a 2% aqueous solution of the following surfactant (2) and 0.8 parts of a 2% aqueous solution of the following surfactant (3), and emulsified for 5 minute using a homogenizer (made by Nippon Seiki Co., Ltd.) at the revs of 10,000. Thus, a light-curable composition dispersion (2) is obtained.

Additionally, the structural formulae of the polymerizable group-containing electron-accepting compound (3), the auxiliary agent (1), the surfactant (2) and the surfactant (3) used in preparing the light-curable composition dispersion (2) are shown below.

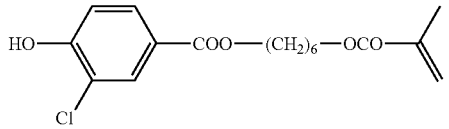

Poliy merizable Electron-accepting Compound (3)

-continued

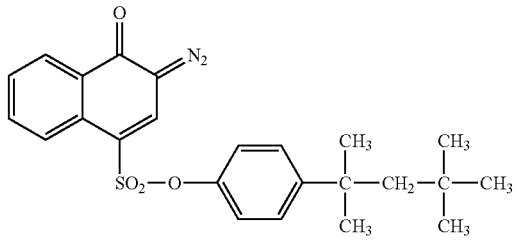

Auxilisry Agent (1)

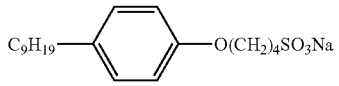

Surfactant (2)

-continued

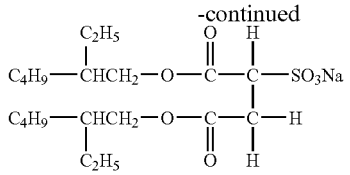

Surfactant (3)

—Light-Curable Composition Dispersion (3)—

A light-curable composition dispersion (3) is prepared in the same manner as in the case of preparing the light-curable composition dispersion (2), except that 0.1 parts of the spectral sensitizing dye-attached boron compound (II) shown above is used in place of the spectral sensitizing dye-attached boron compound (I).

(Preparation of Resin-Particle Dispersion)

Styrene: 460 parts n-Butyl acrylate: 140 parts

Acrylic acid: 12 parts

Dodecanethiol: 9 parts

The above ingredients are mixed and dissolved to prepare a solution. Then, a solution of 12 parts of an anionic surfactant (DOWFAX, produced by Rhodia) in 250 parts of ion exchange water is added to the foregoing solution placed in a flask, and dispersed and emulsified therein to prepare an emulsion (monomer emulsion A).

In addition, 1 part of an anionic surfactant (DOWFAX, produced by Rhodia) is dissolved in 555 parts of ion exchange water, and placed in a flask for polymerization use. The flask is hermetically stoppered, equipped with a reflux condenser, heated up to 75° C. by means of a water bath while admitting nitrogen gas and stirring slowly, and held as it is.

Then, a solution prepared by dissolving 9 parts of ammonium persulfate in 43 parts of ion exchange water is dripped into the flask for polymerization use via a metering pump over a period of 20 minutes, and then the monomer emulsion A is further dripped into the flask via the metering pump over a period of 200 minutes.

Thereafter, the flask is kept at 75° C. for 3 hours with slow stirring, thereby finishing the polymerization.

Thus, a resin-particle dispersion having a median particle diameter of 210 nm, a glass transition point of 51.5° C., a weight-average molecular weight of 31,000 and a solids concentration of 42% is obtained.

Preparation of Toner-1 (Color Generation Area Dispersion Structure Type)

—Preparation of Light-and-Heat-Sensitive Capsule Dispersion (1)—

Microcapsule dispersion (1): 150 parts

Light-curable composition dispersion (1): 300 parts

Aluminum polychloride: 0.20 parts

Ion exchange water: 300 parts

A raw material solution prepared by mixing the above ingredients is adjusted to pH 3.5 by addition of nitric acid, thoroughly mixed and dispersed with a homogenizer (Ultra-Turrax T50, made by IKA), and then transferred to a flask. The flask is heated to 40° C. with an oil bath for heating use while stirring with a THREE ONE MOTOR, and held at 40° C. for 60 minutes. Thereafter, 300 parts of the resin-particle dispersion is further added to the flask, and stirred softly for 2 hours at 60° C. Thus, a light-and-heat-sensitive capsule dispersion (1) is obtained.

Additionally, the volume-average particle size of the light-and-heat-sensitive capsules dispersed in this dispersion is 3.53 μm. During the preparation of this dispersion, no spontaneous color generation is observed in the dispersion.

—Preparation of Light-and-Heat-Sensitive Capsule Dispersion (2)—

Microcapsule dispersion (2): 150 parts

Light-curable composition dispersion (2): 300 parts

Aluminum polychloride: 0.20 parts

Ion exchange water: 300 parts

A light-and-heat-sensitive capsule dispersion (2) is obtained in the same manner as in the case of preparation of the light-and-heat-sensitive capsule dispersion (1), except that the foregoing ingredients are used as the raw material solution.

Additionally, the volume-average particle size of the light-and-heat-sensitive capsules dispersed in this dispersion is 3.52 μm. During the preparation of this dispersion, no spontaneous color generation is observed in the dispersion.

—Preparation of Light-and-Heat-Sensitive Capsule Dispersion (3)—

Microcapsule dispersion (3): 150 parts

Light-curable composition dispersion (3): 300 parts

Aluminum polychloride: 0.20 parts

Ion exchange water: 300 parts

A light-and-heat-sensitive capsule dispersion (3) is obtained in the same manner as in the case of preparation of the light-and-heat-sensitive capsule dispersion (1), except that the foregoing ingredients are used as the raw material solution.

Additionally, the volume-average particle size of the light-and-heat-sensitive capsules dispersed in this dispersion is 3.47 μm. During the preparation of this dispersion, no spontaneous color generation is observed in the dispersion.

—Preparation of Toner—

Light-and-heat-sensitive capsule dispersion (1): 750 parts

Light-and-heat-sensitive capsule dispersion (2): 750 parts

Light-and-heat-sensitive capsule dispersion (3): 750 parts

A solution prepared by mixing the above ingredients is transferred to a flask, heated up to 42° C. with an oil bath for heating use while stirring inside the flask, and held at 42° C. for 60 minutes. Thereafter, 100 parts of the resin-particle dispersion is further added and stirred softly.

Then, the pH inside the flask is adjusted to 5.0 with a 0.5 mol/l of aqueous sodium hydroxide solution, and heated up to 55° C. with continuous stirring. Until the time when the temperature inside the flask goes up to 55° C., the pH inside the flask generally decreases to 5.0 or below, but it is controlled to retain above 4.5 by further addition of the aqueous sodium hydroxide solution. In this situation, the flask is kept at 55° C. for 3 hours.

At the conclusion of the reaction, the reaction product is cooled, filtered, washed thoroughly with ion exchange water, and subjected to solid-liquid separation by Nutsche suction filtration. The product thus separated is washed by re-dispersion in 3 liter of 40° C. ion exchange water placed in a 5-liter beaker and subsequent 15 minutes' stirring at 300 rpm. This washing operation is repeated 5 times, then solid-liquid separation by Nutsche suction filtration is carried out, and further freeze vacuum drying is carried out for 12 hours. Thus, toner particles each having light-and-heat-sensitive capsules dispersed in styrene resin are obtained. The volume-average particle size D50v of these toner particles is found to be 15.2 μm by measurement with a Coulter counter.

Subsequently thereto, 1.0 part of hydrophobic silica (TS720, produced by Cabot Corporation) is added to 50 parts of the toner particles, and mixed with a sample mill to prepare surface-additive bearing Toner-1.

(Toner-2: Preparation of Photo-Color-Generation Toner)

Preparation of Microcapsule Dispersions

—Microcapsule Dispersion (1)—

A solution is prepared by dissolving 12.1 parts of the foregoing electron-donating colorless dye (1) in 10.2 parts of ethyl acetate and adding thereto 12.1 parts of dicyclohexyl phthalate, 26 parts of Takenate D-110N (a product of Takeda Pharmaceutical Company Limited) and 2.9 parts of Millionate MR200 (a product of Nippon Polyurethane Industry Co., Ltd.).

Successively thereto, the solution prepared is added to a mixture of 5.5 parts of polyvinyl alcohol and 73 parts of water, and emulsified and dispersed at 20° C. Thus, an emulsion having an average particle size of 0.5 μm is obtained. To the emulsion obtained, 80 parts of water is added, and heated up to 60° C. with stirring. After a lapse of 2 hours, a microcapsule dispersion (1), wherein microcapsules containing as the core material the electron-donating colorless dye (1) are dispersed, is obtained.

Additionally, the glass transition temperature of the material constituting the outer shell of microcapsules contained in the microcapsule dispersion (1) (the material produced by reaction between dicyclohexyl phthalate, Takenate D-110N and Millionate MR200 under almost the same condition as mentioned above) is about 130° C.

—Microcapsule Dispersion (2)—

A microcapsule dispersion (2) is obtained in the same manner as in the case of preparation of the microcapsule dispersion (1), except that the foregoing electron-donating colorless dye (2) is used in place of the electron-donating colorless dye (1).

—Microcapsule Dispersion (3)—

A microcapsule dispersion (3) is obtained in the same manner as in the case of preparation of the microcapsule dispersion (1), except that the foregoing electron-donating colorless dye (3) is used in place of the electron-donating colorless dye (1).

Preparation of Light-Curable Composition Dispersions

—Light-Curable Composition Dispersion (1)—

To a solution prepared by dissolving 1.62 parts of a photopolymerization initiator (1-a) and 0.54 parts of a photopolymerization initiator (1-b) in 4 parts of ethyl acetate, 9 parts of an electron-accepting compound (1) and 7.5 parts of trimethylolpropane triacrylate monomer (trifunctional acrylate, molecular weight: about 300) are added.

The solution thus prepared is added to a mixed solution prepared by mixing 19 parts of a 15% aqueous PVA (polyvinyl alcohol) solution, 5 parts of water, 0.8 parts of a 2% aqueous solution of surfactant (1) and 0.8 parts of a 2% aqueous solution of surfactant (2), and made into an emulsion by 7 minutes' emulsification at 8,000 rmp by means of a homogenizer (made by Nippon Seiki Co., Ltd.). The thus made emulsion is used as a light-curable composition dispersion (1).

—Light-Curable Composition Dispersion (2)—

A light-curable composition dispersion (2) is obtained in the same manner as in the case of preparing the light-curable composition dispersion (1), except that the photopolymerization initiators (1-a) and (1-b) are replaced with a mixture of 0.08 parts of a photopolymerization initiator (2-a), 0.18 parts of a photopolymerization initiator (2-b) and 0.18 parts of a photopolymerization initiator (2-c).

—Light-Curable Composition Dispersion (3)—

A light-curable composition dispersion (3) is prepared in the same manner as in the case of preparing the light-curable composition dispersion (2), except that the photopolymerization initiator (2-b) is replaced with a photopolymerization initiator (3-b).

Additionally, the chemical formulae of the photopolymerization initiators (1-a), (1-b), (2-a), (2-b), (2-c) and (3-b), the electron-accepting compound (1) and the surfactants (1) and (2) used in preparing the light-curable composition dispersions are illustrated below.

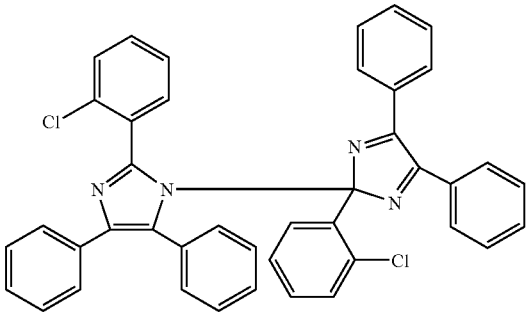

Photopolymerization Initiator (1-a)

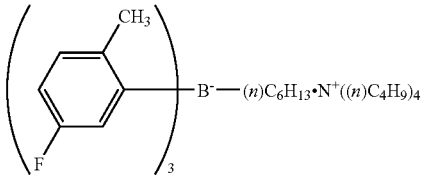

Photopolymerization Initiator (1-b)

-continued

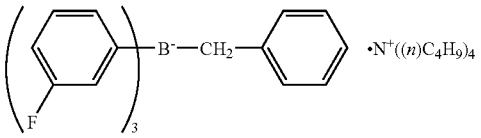

Photopolymerization Initiator (2-a)

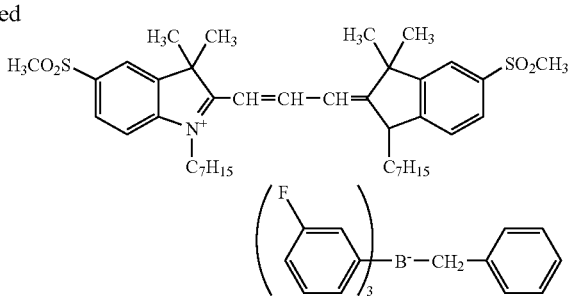

Photopolymerization Initiator (2-b)

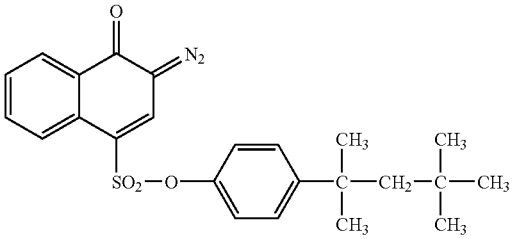

Photopolymerization Initiator (2-c)

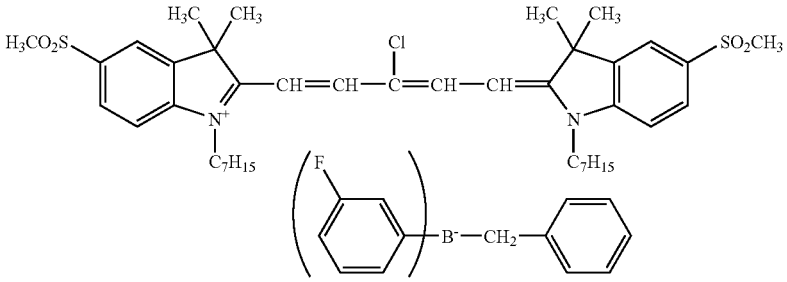

Photopolymerization Initiator (3-b)

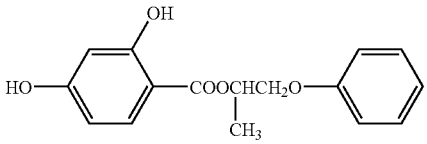

Electron-accepting Compound (1)

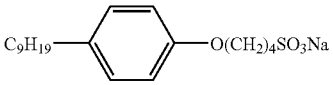

Surfactant (1)

$C_{12}H_{25}SO_3Na$

Surfactant (2)

—Preparation of Resin-Particle Dispersion (1)—

Styrene: 360 parts n-Butyl acrylate: 40 parts

Acrylic acid: 4 parts

Dodecanethiol: 24 parts

Carbon tetrabromide: 4 parts

In a flask, a solution prepared by mixing and dissolving the ingredients described above is dispersed and emulsified in a solution prepared by dissolving 6 parts of a nonionic surfactant (Nonipol 400, produced by Sanyo Chemical Industries, Ltd.) and 10 parts of an anionic surfactant (Neogen SC, produced by Dai-ichi Kogyo Seiyaku Co., Ltd.) in 560 parts of ion exchange water. Into the emulsion obtained, 50 parts of ion exchange water, in which 4 parts of ammonium persulfate is dissolved, is charged over a period of 10 minutes while mixing them gently.

Then, the atmosphere in the flask is replaced with nitrogen, and the contents in the flask are heated up to 70° C. with stirring by use of an oil bath. In this situation, emulsion polymerization is continued for 5 hours. Thus, a resin-particle dispersion (1) (concentration of resin particles: 30%), in which are dispersed resin particles having a volume-average particle size of 200 nm, a glass transition temperature of 50° C., a weight-average molecular weight (Mw) of 16,200 and a specific gravity of 1.2, is obtained.

—Preparation of Light-and-Heat-Sensitive Capsule Dispersion (1)—

Microcapsule dispersion (1): 24 parts

Light-curable composition dispersion (1): 232 parts

The ingredients described above are placed in a circular stainless flask, and thoroughly mixed and dispersed with an ULTRA-TURRAX T50 made by IKA.

The dispersion obtained is adjusted to pH 3 by addition of nitric acid. Thereto, 0.20 parts of aluminum polychloride is added, and a dispersion operation is continued for 10 minutes by use of the ULTRA-TURRAX at the revs of 6,000 rpm. The resulting contents in the flask are heated up to 40° C. with an oil bath for heating use while stirring gently.

At this point, 60 parts of the resin-particle dispersion (1) is further added gradually.

Thus, a light-and-heat-sensitive capsule dispersion (1) is obtained.

Additionally, the volume-average particle size of the light-and-heat-sensitive capsules dispersed in this dispersion is about 2 μm. In the dispersion obtained, no spontaneous color generation is observed.

—Preparation of Light-and-Heat-Sensitive Capsule Dispersion (2)—

A light-and-heat-sensitive capsule dispersion (2) is obtained in the same manner as in the case of preparing the light-and-heat-sensitive capsule dispersion (1), except that the microcapsule dispersion (1) is replaced with the microcapsule dispersion (2) and the light-curable composition dispersion (1) is replaced with the light-curable composition dispersion (2). Additionally, the volume-average particle size of the light-and-heat-sensitive capsules dispersed in this dispersion is about 2 μm. In the dispersion obtained, no spontaneous color generation is observed.

—Preparation of Light-and-Heat-Sensitive Capsule Dispersion (3)—

A light-and-heat-sensitive capsule dispersion (3) is obtained in the same manner as in the case of preparing the light-and-heat-sensitive capsule dispersion (1), except that the microcapsule dispersion (1) is replaced with the microcapsule dispersion (3) and the light-curable composition dispersion (1) is replaced with the light-curable composition dispersion (3). Additionally, the volume-average particle size of the light-and-heat-sensitive capsules dispersed in this dispersion is about 2 μm. In the dispersion obtained, no spontaneous color generation is observed.

Preparation of Toner-2 (Color Generation Area Dispersion Structure Type)

—Preparation of Toner—

Light-and-heat-sensitive capsule dispersion (1): 80 parts
Light-and-heat-sensitive capsule dispersion (2): 80 parts
Light-and-heat-sensitive capsule dispersion (3): 80 parts
Resin-particle dispersion (1): 80 parts The ingredients described above are placed in a circular stainless flask, and thoroughly mixed and dispersed with an ULTRA-TURRAX T50 made by IKA.

Thereto, 0.1 parts of aluminum polychloride is added, and a dispersion operation is continued for 10 minutes by use of the ULTRA-TURRAX at the revs of 6,000 rpm. The resulting contents in the flask are heated up to 48° C. with an oil bath for heating use while stirring gently. After the resulting dispersion is kept at 48° C. for 60 minutes, 20 parts of the resin-particle dispersion (1) is further added gradually.

Thereafter, the dispersion mixture is adjusted to pH 8.5 by addition of a 0.5 mol/l of aqueous sodium hydroxide solution, and then the stainless flask is hermetically sealed. While stirring with the aid of a magnetic force seal, the contents in the flask is heated up to 55° C. and left for 10 hours in this situation.

At the conclusion of the reaction, the reaction product is cooled, filtered, thoroughly washed with ion exchange water, and subjected to solid-liquid separation by Nutsche suction filtration. The product thus separated is further washed by re-dispersion in one liter of 40° C. ion exchange water and 15 minutes' stirring at 300 rpm. This washing operation is repeated 5 times, and when the filtrate comes to have pH 7.5 and electric conductivity of 7.0 μs/cmt, solid-liquid separation is carried out using filter paper No. 5A in accordance with Nutsche suction filtration. The thus separated matter further undergoes 12-hour vacuum drying to yield toner particles each having a structure that three kinds of light-and-heat-sensitive capsules are dispersed in the matrix.

The volume-average particle size D50v of the thus obtained toner particles is found to be about 15 μm by measurement with a Coulter counter. Additionally, no spontaneous color generation is observed in the toner obtained.

Next, 100 parts of this toner, 0.3 parts of hydrophobic titania surface-treated with n-decyltrimethoxysilane and is nm in average particle size, and 0.4 parts of hydrophobic silica 30 nm in average particle size (NY50, a product of Nippon Aerosil Co., Ltd.) are blended for 10 minutes using a Henschel mixer at a peripheral speed of 32 m/s, and then coarse particles are removed by use of a sieve with a 45-μm mesh. Thus, surface-additive bearing toner 2 is obtained by addition of surface additives in the foregoing manner.

(Preparation of Developers)

By kneading 30 mass % of styrene-acrylic copolymer (number-average molecular weight: 23,000, weight-average molecular weight: 98,000, Tg: 78° C.) with 70 mass % of granular magnetite (maximum magnetization: 80 emu/g, average grain size: 0.5 μm), grinding the kneaded matter and sifting the ground matter through a sieve, carrier having a volume-average particle size of 100 μm is made. The carrier thus obtained and each of the toner 1 and the toner 2 weighed in an amount corresponding to toner concentration of 5 mass % are mixed for 5 minutes with a ball mill, thereby preparing developer 1 and developer 2, respectively.

Exemplary Embodiment 1-1

An image forming apparatus having the same configuration (See FIG. 1) as the first exemplary embodiment is prepared, and the developer 1 (a developer containing photo-non-color-generation toner) is charged in the developing device 14 of the image forming unit 10.

The photoconductor 11 used is an aluminum drum measuring 30 mm in diameter which has around the periphery a 25 μm-thick organic photoconductive multiple layer formed by coating and made up of a charge generating layer containing gallium chloride phthalocyanine and a charge transporting layer containing N,N'-diphenyl-N,N'-bis(3-methylphenyl)-[1,1']biphenyl-4,4'-diamine.

The charging device 12 used is a scorotron.

The exposure device 13 used is a 780-nm LED image bar enabling latent image formation in resolution of 600 dpi.

The developing device 14 is equipped with a metal sleeve for two-component magnetic brush development, and can perform reversal development. Additionally, the amount of charge on the toner when the developer is charged in this developing device is of the order of −5 to −30 μC/g.

In the first transfer device 15 used, a semiconductive roll having a conductive core around which is covered with an elastic conductivity solid is adopted as the transfer roll. The elastic conductivity solid is an incompatible blend of NBR and EPDM in which two kinds of carbon black, KETJEN-BLACK and thermal black, are dispersed, and has a roll resistance of $10^{8.5}$ Ωcm and an ASKER C hardness of 35 degrees.

The color-generation information giving device 21 used is an LED image bar with 600 dpi resolution which can emit light with a peak wavelength of 405 nm (exposure amount: 0.2 mJ/cm$^2$), light with a peak wavelength of 532 nm (exposure amount: 0.2 mJ/cm$^2$) and light with a peak wavelength of 657 nm (exposure amount: 0.4 mJ/cm$^2$).

As to the second transfer device 22 used, a semiconductive roll having a conductive core around which is covered with an elastic conductivity solid is adopted as the transfer roll. The elastic conductivity solid is an incompatible blend of NBR and EPDM in which two kinds of carbon black, KETJEN-BLACK and thermal black, are dispersed, and has a roll resistance of $10^{8.5}$ Ωcm and an ASKER C hardness of 35 degrees.

The fixing device 23 used is the same fixing device as loaded in DPC1616 made by Fuji Xerox Co., Ltd., and it is disposed in a position 30 cm apart from the color-generation information giving point.

As to the light irradiation device 24, a high-intensity schaukasten (light box) including the three wavelengths of the foregoing color-generation information giving device is used, and the irradiation width is set at 5 mm.

As the intermediate transfer belt 20, a semiconductive belt made in the following manner is used.

[Making of Semiconductive Belt (White Polyimide Belt)]

—Preparation of Polyamic Acid Solution (A)—

To an N-methyl-2-pyrrolidone (NMP) solution of polyamic acid prepared from 3,3',4,4'-biphenyltetracarboxylic dianhydride (BPDA) and 4,4'-diaminodiphenyl ether (DDE) (U-Varnish S (solids content: 18 mass %, produced by Ube Industries, Ltd.), zinc oxide whisker (Item No. WZ-0501, produced by Matsushita Electric Industrial Co., Ltd.) and conductive zinc oxide (Item No. 23-KC: 23-K treated with silane coupling agent, produced by Hakusui Tech Co., Ltd.) are added as white conductive agents in amounts corresponding to 10 parts by mass and 20 parts by mass, respectively, per 100 parts by mass of the solid component of the raw material capable of forming polyimide resin in the foregoing solution, and mixed using a collision-type dispersing machine (Geanus PY, made by Geanus Co., Ltd.) under conditions that the pressure of 200 MPa is applied and the solution is passed 5 times through a path where the solution is brought into collision after division into two parts with the minimum area of 1.4 mm$^2$ and then divided into two parts again, thereby preparing zinc oxide-incorporated polyamic acid solution (A).

—Making of Semiconductive Belt—

The zinc oxide-incorporated polyamic acid solution (A) is coated on the inner surface of a cylindrical mold via a dispenser so that the coating thickness becomes 0.5 mm, and the mold is rotated at 1,500 rpm for 15 minutes to form a coating with a uniform thickness. Then, 60° C. hot air is blown on the outer surface of the mold for 30 minutes while rotating the mold at 250 rpm, and further the mold is heated at 150° C. for 60 minutes. Thereafter, the mold is cooled down to room temperature to form a film.

The film formed on the inner surface of the mold is peeled off. A metal core is covered with this film so that the periphery thereof is clad in the film, then heated up to 400° C. at a temperature rising speed of 2° C./min, and further kept at 400° C. for 30 minutes. By such heating treatment, not only the solvent remaining in the film and dehydration ring-closure water are removed, but also imide conversion reaction is completed. Thereafter, the metal core is cooled down to room temperature, and then the polyimide film formed on the metal core surface is peeled off. Thus, a 0.08 mm-thick base material in endless belt form is obtained, and this base material is adopted as a semiconductive belt.

The semiconductive belt thus obtained has a Young's modulus of 3,900 Mpa, a thermal expansion coefficient of 16 PPM/° C., a volume resistivity of $1\times10^{9}$ Ωcm, and a surface resistivity of $1\times10^{11.2}$Ω/□.

The ten-point-average surface roughness Rz of the belt is 2.1 μm

In the image forming apparatus configured as described above, printing conditions are set as follows.

—Conditions of Image Forming Unit—

Linear speed of photoconductor: 10 mm/sec

Charging conditions: −400V is applied to the scorotron screen and a direct voltage −6 kV to the wire. At this time, the surface potential of the photoconductor becomes −400 V.

Exposure: Exposure is carried out via black image information, and the potential after exposure becomes about −50V.

Development bias: Rectangular waves of alternating $V_{pp}$ 1.2 kV (3 kHz) are superposed on a direct voltage −330V.

Developer contact conditions: The peripheral speed ratio (developing roll/photoconductor) is adjusted to 2.0, the development gap to 0.5 mm, the developer weight on the developing roll to 400 g/m$^2$, and the amount of toner development on the photoconductor to 5 g/m$^2$ on a solid image basis.

Bias for transfer to intermediate transfer belt: A direct voltage of +800V is applied.

—Other Conditions—

Bias for transfer to recording medium: A direct voltage of +1 kV is applied.

Fixing temperature: The surface temperature setting of the fixing roll is 180° C.

Illuminance of light irradiation device: 130,000 lux

Under these conditions, a printed record of a chart having gradation image areas pertaining to Y, M, C, R, G, B and K colors, respectively, is produced. Additionally, the color-generation information is given to the F toner by respectively using combinations shown in Table 1 (which indicates that, when LED or LEDs marked with a term "on" emit light, the toner generates the intended color). In addition, in order to control the generated color density by light emission intensity or light emission time, time-width modulation where one-dot time is divided into 8 equal portions is adopted.

TABLE 1

| | | Generated Color | | | | | | | |
|---|---|---|---|---|---|---|---|---|---|
| | | Y color | M color | C color | R color | G color | B color | K color | W color |
| Wavelength of LED | 405 nm | | on | on | | | on | | on |
| | 532 nm | on | | on | | on | | | on |
| | 657 nm | on | on | | on | | | | on |

(Image Evaluation)

The print sample obtained under the foregoing conditions is evaluated as follows.

—Generated Color Density—

When the image density of a solid image area of each of Y, M and C colors is examined with a density measuring instrument X-Rite 938 (made by X-Rite), it is found to be 1.5 or above, and sufficient color generation is ascertained with respect to every color.

—Reproducibility of Highlight Image Area—

Prints having 15% halftone images throughout their surfaces are examined for reproducibility of highlight image area, and it is ascertained that they are good prints free of dropouts in highlight areas.

—Color Reproducibility—

Color reproducibility is evaluated in accordance with the following criteria for image quality after fixing.

A: Color generation of each toner is sufficient and color reproducibility of image is good.

B: Color generation is slightly insufficient, but there is no problem in color reproducibility of image.

C: Color generation is more or less insufficient, but there is no problem from a practical point of view.

F: Color generation of each toner is insufficient and the color reproduction desired is not achieved, so there is a problem in point of practicality.

—Transferred Image Quality—

With respect to the transferred image quality, image-quality defects (including blur, hollow characters and out-of-resister colors) and cleanability are evaluated in accordance with the criteria described below.

A: Occurrence of image-quality defects is rare, and there is no image-quality problem.

B: Image-quality defects occur, but there is no image-quality problem.

F: Image-quality defects occur to an extent of causing an image-quality problem.

Exemplary Embodiment 1-2

Except that the intermediate transfer belt 20 used is a semiconductive belt made in the following manner, the same evaluations as in Exemplary Embodiment 1-1 are carried out, and results obtained are shown in Table 2.

[Making of Semiconductive Belt (Black Polyimide Belt)]

—Preparation of Polyamic Acid Solution (B)—

To an N-methyl-2-pyrrolidone (NMP) solution of polyamic acid prepared from 3,3',4,4'-biphenyltetracarboxylic dianhydride (BPDA) and 4,4'-diaminodiphenyl ether (DDE) (U-Varnish S (solids content: 18 mass %), produced by Ube Industries, Ltd.), dried oxidation-treated carbon black (SPECIAL BLACK 4, produced by Degussa AG, pH: 3.0, volatile component: 14.0%) is added in an amount corresponding to 23 parts by mass per 100 parts by mass of the solid component of the raw material capable of forming polyimide resin in the foregoing solution, and mixed using a collision-type dispersing machine (Geanus PY, made by Geanus Co., Ltd.) under conditions that the pressure of 200 MPa is applied and the solution is passed 5 times through a path where the solution is brought into collision after division into two parts with the minimum area of 1.4 $mm^2$ and then divided into two parts again, thereby preparing carbon black-incorporated polyamic acid solution (B).

—Making of Semiconductive Belt—

The carbon black-incorporated polyamic acid solution (B) is coated on the inner surface of a cylindrical mold via a dispenser so that the coating thickness becomes 0.5 mm, and the mold is rotated at 1,500 rpm for 15 minutes to form a coating with a uniform thickness. Then, 60° C. hot air is blown on the outer surface of the mold for 30 minutes while rotating the mold at 250 rpm, and further the mold is heated at 150° C. for 60 minutes. Thereafter, the mold is cooled down to room temperature to form a film.

The film formed on the inner surface of the mold is peeled off. A metal core is covered with this film so that the periphery thereof is clad in the film, then heated up to 400° C. at a temperature rising speed of 2° C./min, and further kept at 400° C. for 30 minutes. By such heating treatment, not only the solvent remaining in the film and dehydration ring-closure water are removed, but also imide conversion reaction is completed. Thereafter, the metal core is cooled down to room temperature, and then the polyimide film formed on the metal core surface is peeled off. Thus, a 0.08 mm-thick base material in endless belt form is obtained, and this base material is adopted as a semiconductive belt.

The semiconductive belt thus obtained has a Young's modulus of 3,800 Mpa, a thermal expansion coefficient of 18 PPM/° C., a volume resistivity of $1\times10^{9.5}$ Ωcm, and a surface resistivity of $1\times10^{12}$Ω/□.

The ten-point-average surface roughness Rz of the belt is 1.2 μm

Exemplary Embodiment 1-3

Except that the intermediate transfer belt 20 used is a semiconductive belt made in the following manner, the same evaluations as in Exemplary Embodiment 1-1 are carried out, and results obtained are shown in Table 2.

[Making of Semiconductive Belt (White Surface Layer-Coated Black Polyimide Belt)]

The following surface layer is formed on the black polyimide belt (base material) made in Exemplary Embodiment 1-2. Two-liquid cure type of water-based urethane resin paint (Emralon 345, produced by Acheson (Japan) Ltd.) containing, per 100 parts by mass of the resin component, 28 parts by mass of conductive zinc oxide as a white conductive agent (Item No. 23-KC, produced by Hakusui Tech Co., Ltd.) and 20 parts by mass of fluorocarbon resin particles (Lubron L-5, average particle size: 0.2 μm, a product of Daikin Industries, Ltd.) is mixed with block isocyanate as a curing agent (WH-2, a product of Acheson (Japan) Ltd.) in a mixing ratio of 100:10 to prepare a mixed solution. The mixed solution obtained is spray-coated on the base material surface, and heated and dried for 15 minutes at 120° C. to form a 20 μm-thick surface layer made up of the white conductive agent, the fluorocarbon resin particles and the urethane resin. This material is adopted as a semiconductive belt.

The thus made semiconductive belt has a volume resistivity of $8\times10^{10}$ Ωcm and a ten-point-average surface roughness Rz of 9 μm.

Exemplary Embodiment 1-4

Except that the intermediate transfer belt 20 used is a semiconductive belt made in the following manner, the same evaluations as in Exemplary Embodiment 1-1 are carried out, and results obtained are shown in Table 2.

[Making of Semiconductive Belt (White Polyfluorovinylidene Resin Belt)]

To 100 parts by mass of polyfluorovinylidene resin (#850, trade name, a product of Kureha Chemical Industry Co., Ltd.), 10 parts by mass of zinc oxide whisker (Item No. WZ-0501, produced by Matsushita Electric Industrial Co., Ltd.) and 20 parts by mass of conductive zinc oxide (Item No. 23-KC, produced by Hakusui Tech Co., Ltd.) are added as white conductive agents. This admixture is dispersed and kneaded with a biaxial extrusion machine to prepare a resinous composition. This composition is formed into a 0.12 mm-thick endless belt by means of a uniaxial extruder, thereby obtaining a white semiconductive belt.

The semiconductive belt thus obtained has a Young's modulus of 2,400 Mpa, a thermal expansion coefficient of 95 PPM/° C., a volume resistivity of $1\times10^{11}$ Ωcm, a surface resistivity of $1\times10^{11}$Ω/□, and a ten-point-average surface roughness Rz of 3.5 μm.

Exemplary Embodiment 1-5

Except that the intermediate transfer belt 20 used is a semiconductive belt made in the following manner, the same evaluations as in Exemplary Embodiment 1-1 are carried out, and results obtained are shown in Table 2.

[Making of Semiconductive Belt (Black Polyfluorovinylidene Resin Belt)]

To 100 parts by mass of polyfluorovinylidene resin (#850, trade name, a product of Kureha Chemical Industry Co., Ltd.), 23 parts by mass of dried oxidation-treated carbon black (SPECIAL BLACK 4, produced by Degussa AG, pH: 3.0, volatile component: 14.0%), 10 parts by mass of zinc oxide whisker (Item No. WZ-0501, produced by Matsushita Electric Industrial Co., Ltd.) and 20 parts by mass of conductive zinc oxide (Item No. 23-KC, produced by Hakusui Tech Co., Ltd.) are added as conductive agents. This admixture is dispersed and kneaded with a biaxial extrusion machine to prepare a resinous composition. This composition is formed into a 0.12 mm-thick endless belt by means of a uniaxial extruder, thereby obtaining a black semiconductive belt.

The semiconductive belt thus obtained has a Young's modulus of 2,400 Mpa, a volume resistivity of $1\times10^{10.2}$ Ωcm, a surface resistivity of $1\times10^{11.5}$Ω/□, and a ten-point-average surface roughness Rz of 3.0 μm.

Exemplary Embodiment 1-6

Except that the intermediate transfer belt 20 used is a semiconductive belt made in the following manner, the same evaluations as in Exemplary Embodiment 1-1 are carried out, and results obtained are shown in Table 2.

[Making of Semiconductive Belt (White Surface Layer-Coated Black Polyfluorovinylidene Resin Belt)]

The following surface layer is formed on the black polyfluorovinylidene resin belt (base material) made in Exemplary Embodiment 1-5. Two-liquid cure type of water-based urethane resin paint (Emralon 345, produced by Acheson (Japan) Ltd.) containing, per 100 parts by mass of the resin component, 28 parts by mass of conductive zinc oxide as a white conductive agent (Item No. 23-KC, produced by Hakusui Tech Co., Ltd.) and 20 parts by mass of fluorocarbon resin particles (Lubron L-5, average particle size: 0.2 μm, a product of Daikin Industries, Ltd.) is mixed with block isocyanate as a curing agent (WH-2, a product of Acheson (Japan) Ltd.) in a mixing ratio of 100:10 to prepare a mixed solution. The mixed solution obtained is spray-coated on the base material surface, and heated and dried for 15 minutes at 120° C. to form a 20 μm-thick surface layer made up of the white conductive agent, the fluorocarbon resin particles and the urethane resin. This material is adopted as a semiconductive belt.

The thus made semiconductive belt has a volume resistivity of $1\times10^{10.5}$ Ωcm and a ten-point-average surface roughness Rz of 9 μm.

Exemplary Embodiment 1-7

Except that the intermediate transfer belt 20 used is a semiconductive belt made in the following manner, the same evaluations as in Exemplary embodiment 1-1 are carried out, and results obtained are shown in Table 2.

[Making of Semiconductive Belt (White Surface Layer-Coated Black Polyimide Belt)]

The following surface layer is formed on the black polyimide belt (base material) made in Exemplary embodiment 1-2. Two-liquid cure type of water-based urethane resin paint (Emralon 345, produced by Acheson (Japan) Ltd.) containing, per 100 parts by mass of the resin component, 30 parts by mass of conductive zinc oxide as a white conductive agent (Item No. Pazet CK, produced by Hakusui Tech Co., Ltd.) and 20 parts by mass of fluorocarbon resin particles (Lubron L-5, average particle size: 0.2 μm, a product of Daikin Industries, Ltd.) is mixed with block isocyanate as a curing agent (WH-2, a product of Acheson (Japan) Ltd.) in a mixing ratio of 100:10 to prepare a mixed solution. The mixed solution obtained is spray-coated on the base material surface, and heated and dried for 15 minutes at 120° C. to form a 20 μm-thick surface layer made up of the white conductive agent, the fluorocarbon resin particles and the urethane resin. This material is adopted as a semiconductive belt.

The thus made semiconductive belt has a volume resistivity of $1\times10^{11.5}$ Ωcm and a ten-point-average surface roughness Rz of 14 μm.

Exemplary Embodiment 1-8

Except that the intermediate transfer belt 20 used is a semiconductive belt made in the following manner, the same evaluations as in Exemplary embodiment 1-1 are carried out, and results obtained are shown in Table 2.

[Making of Semiconductive Belt (White Surface Layer-Coated Black Polyimide Belt)]

The following surface layer is formed on the black polyimide belt (base material) made in Exemplary embodiment 1-2. Two-liquid cure type of water-based urethane resin paint (Emralon 345, produced by Acheson (Japan) Ltd.) containing, per 100 parts by mass of the resin component, 18 parts by mass of conductive zinc oxide as a white conductive agent (Item No. Pazet GK, produced by Hakusui Tech Co., Ltd.) and 10 parts by mass of fluorocarbon resin particles (Lubron L-5, average particle size: 0.2 μm, a product of Daikin Industries, Ltd.) is mixed with block isocyanate as a curing agent (WH-2, a product of Acheson (Japan) Ltd.) in a mixing ratio of 100:10 to prepare a mixed solution. The mixed solution obtained is spray-coated on the base material surface, and heated and dried for 15 minutes at 120° C. to form a 20 μm-thick surface layer made up of the white conductive agent, the fluorocarbon resin particles and the urethane resin. This material is adopted as a semiconductive belt.

The thus made semiconductive belt has a volume resistivity of $1\times10^{11}$ Ωcm and a ten-point-average surface roughness Rz of 1.3 μm.

Exemplary Embodiment 1-9

An image forming apparatus having the same configuration as another example of the first exemplary embodiment (See FIG. 4) is prepared, and a drum made in the following manner is used as the intermediate transfer drum 20A. Except for this point, image quality evaluations are carried out under the same conditions as in Exemplary embodiment 1-1, and results obtained are shown in Table 2.

[Making of Intermediate Transfer Drum (Black Intermediate Transfer Drum)]

—Making of Base Material—

An aluminum pipe material measuring 248 mm in length and 30 mm in outside diameter is lathed in the proximity to both ends, and flanges having a shaft are press-fitted in the lathed portions. Further, the surface of the aluminum pipe material is lathed and polished so as to have an outside diameter tolerance of 0.01 mm or below and an outside deflection accuracy of 0.01 mm as measured with respect to the flange shaft. The thus finished aluminum pipe is adopted as a base material.

—Formation of Elastic Layer—

The surface of this pipe is blast-processed, and coated with a primer. Thereon, an elastic layer is further formed in the following manner.

Rubber Preparation 1

Epichlorohydrin rubber (1): 75 parts by mass

Acrylonitrile-butadiene rubber (2): 25 parts by mass

Vulcanizing agent: Sulfur (a product of Tsurumi Chemical Co., Ltd., 200 mesh): 5 parts by mass Rubber accelerator (Nocseller M, produced by OuchiShinko Chemical Industrial Co., Ltd.): 1.5 parts by mass Vulcanization aid (zinc oxide): 5 parts by mass Anti-aging agent (Noclak 224S, produced by OuchiShinko Chemical Industrial Co., Ltd.): 1 part by mass Processing aid (stearic acid): 1 part by mass Plasticizer (DOP, produced by Daihachi Chemical Industry Co., Ltd.): 10 parts by mass Carbon black (particulate acetylene black, produced by Denki Kagaku Kogyo Kabushiki Kaisha): 18 parts by mass Herein, the epichlorohydrin rubber (1) used is Gechron 3103 produced by Zeon Corporation (ethylene oxide content: 35 mol %), and the acrylonitrile-butadiene rubber (2) used is Nipol DN-219 produced by Zeon Corporation (acrylonitrile content: 33.5 mass %).

The ingredients of the rubber preparation 1 are charged into a Banbury mixer, kneaded for 2 minutes at an initial temperature of 50° C., and then kneaded with a two-rod roll mill. The thus kneaded matter is molded into the form of tube by use of a tube crosshead extruder. Then, the blended rubber material thus molded is heated and vulcanized with pressurized steam, the temperature of which is 126° C. and the pressure of which is 1.5 kg/cm$^2$G, in a vulcanizing can, thereby forming an elastic layer. The outside of the aluminum pipe material measuring 248 mm in length and 30 mm in outside diameter is covered with the thus formed elastic layer. The surface of the resulting matter is polished to result in formation of a layer having a thickness of 5 mm, an outside diameter $\phi$ of 40 mm, a width of 248 mm and a volume resistivity of $6\times10^8$ Ωcm. Additionally, the elastic layer obtained has a durometer hardness of C50/S.

—Formation of Surface Layer—

A surface layer is formed on the elastic layer in the following manner. Two-liquid cure type of water-based urethane resin paint (Emralon 345, produced by Acheson (Japan) Ltd.) containing, per 100 parts by mass of the resin component, 25 parts by mass of a conductive agent (particulate acetylene black produced by Denki Kagaku Kogyo Kabushiki Kaisha) and 20 parts by mass of fluorocarbon resin particles (Lubron L-5, average particle size: 0.2 μm, a product of Daikin Industries, Ltd.) is mixed with block isocyanate as a curing agent (WH-2, a product of Acheson (Japan) Ltd.) in a mixing ratio of 100:10 to prepare a mixed solution. The mixed solution obtained is spray-coated on the base material surface, and heated and dried for 15 minutes at 120° C. to form a 20 μm-thick surface layer made up of the black conductive agent, the fluorocarbon resin particles and the urethane resin.

The thus made intermediate transfer drum has a volume resistivity of $8\times10^{10}$ Ωcm and a ten-point-average surface roughness Rz of 7 μm.

Exemplary Embodiment 1-10

Except for the use of an intermediate transfer drum made in the following manner as the intermediate transfer drum 20A, image quality evaluations are carried out under the same conditions as in Exemplary embodiment 1-9, and results obtained are shown in Table 2.

[Making of Intermediate Transfer Drum (White Surface Layer-Coated Black Intermediate Transfer Drum)]

An intermediate transfer drum is formed in the same manner as in Exemplary embodiment 1-9, except that the surface layer is changed to a surface layer formed as follows: Two-liquid cure type of water-based urethane resin paint (Emralon 345, produced by Acheson (Japan) Ltd.) containing, per 100 parts by mass of the resin component, 28 parts by mass of conductive zinc oxide as a white conductive agent (Item No. 23-KC, produced by Hakusui Tech Co., Ltd.) and 20 parts by mass of fluorocarbon resin particles (Lubron L-5, average particle size: 0.2 μm, a product of Daikin Industries, Ltd.) is mixed with block isocyanate as a curing agent (WH-2, a product of Acheson (Japan) Ltd.) in a mixing ratio of 100:10 to prepare a mixed solution. The mixed solution obtained is spray-coated on the base material surface, and heated and dried for 15 minutes at 120° C. to form a 20 μm-thick surface layer made up of the white conductive agent, the fluorocarbon resin particles and the urethane resin.

The thus made intermediate transfer drum has a volume resistivity of $1\times10^{10.8}$ Ωcm and a ten-point-average surface roughness Rz of 9 μm.

Exemplary Embodiment 1-11

An image forming apparatus having the same configuration as another example of the second exemplary embodiment (See FIG. 5) is prepared, and the same semiconductive belt as made in Exemplary embodiment 1-1 is used as the transport-to-transfer belt 28. Except for this point, image quality evaluations are carried out under the same conditions as in Exemplary embodiment 1-1, and results obtained are shown in Table 2.

Comparative Example 1

Image quality evaluations are carried out under the same conditions as in Exemplary embodiment 1-1, except that the intermediate transfer system adopted in Exemplary embodiment 1-1 is replaced with a system that toner image is transferred to web paper wound into a roll, and color-generation information is given to the toner image transferred to the web paper, and further the resulting toner image is fixed and subjected to exposure for color generation.

In addition to the evaluation results of color reproducibility and transferred image quality in Exemplary embodiments 1-1 to 1-11 and in Comparative Example 1, reflectivity and surface roughness of each intermediate transfer medium (or the transport-to-transfer belt) are summarized in Table 2.

TABLE 2-1

| | Exemplary embodiment 1-1 | Exemplary embodiment 1-2 | Exemplary embodiment 1-3 | Exemplary embodiment 1-4 | Exemplary embodiment 1-5 | Exemplary embodiment 1-6 | Exemplary embodiment 1-7 | Exemplary embodiment 1-8 |
|---|---|---|---|---|---|---|---|---|
| Reflectivity % | 76 | 1 | 95 | 91 | 1 | 93 | 86 | 96 |
| Surface Roughness μm | 2.1 | 1.2 | 9 | 3.5 | 3 | 9 | 14 | 1.3 |
| Color Reproducibility | B | C | A | A | C | A | B | A |
| Transferred Image Quality | A | A | A | B | B | B | B | B |

As can seen from the results shown in Table 2, each Exemplary embodiment may consistently provide images free of image-quality defects for a long time by using toner capable of controlling a color-generation state or a non-color-generation state according to color-generation information by means of light, as compared to Comparative Example.

Additionally, the intermediate transfer belt is poorly cleaned in Exemplary embodiment 1-7 because of its great surface roughness, and there slightly occur toner adhesion to the belt and degradation in image quality such as unevenness in halftone. In Exemplary embodiment 1-8, on the other hand, slight out-of-register colors are caused by influences of the photoconductor in a contact state.

Exemplary Embodiment 2

Image formation is carried out in the same manner as in Exemplary embodiment 1-1, except that the linear speed of the photoconductor 11 is changed to 300 mm/sec, and image evaluations are carried out in the same way as in Exemplary embodiment 1-1. In addition, image formation is carried out under the same condition as mentioned above, except that the fixing device and the light exposure device are dismounted from the apparatus, and unfixed images are output, allowed to stand for 10 minutes in a dark place, then fixed at the same speed and temperature as in Exemplary embodiment 1-1 and further subjected to light exposure.

As a result, images whose generated color densities, the color reproducibility and the highlight image area reproducibility are compared with those of prints obtained in Exemplary embodiment 1-1 are obtained irrespective of whether or not they are allowed to stand in the dark.

Exemplary Embodiment 3

Image formation is carried out in the same manner as in Exemplary embodiment 1-1, except that the developer 1 of the image forming unit 10 is replaced with the developer 2 and the light combination for giving color generation information to the F toner is change to the combination shown in Table 3, and the same image evaluations as in Exemplary embodiment 1-1 are carried out.

As a result, it is found that the generated color densities are 1.5 or above, the images obtained are equal in color reproducibility and highlight reproducibility to those obtained in Exemplary embodiment 1 on the visual observation level, and even the use of the toner of photo-color-generation type may deliver excellent properties covering generated color density, color reproducibility and highlight area reproducibility as in the case of using the toner of photo-non-color-generation type in Exemplary embodiment 1.

TABLE 3

| | | Generated Color | | | | | | | |
|---|---|---|---|---|---|---|---|---|---|
| | | Y color | M color | C color | R color | G color | B color | K color | W color |
| Wavelength of LED | 405 nm | on | | | on | on | | on | |
| | 532 nm | | on | | on | | on | on | |
| | 657 nm | | | on | | on | on | on | |

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image carrier;

a toner image forming unit that uses a developer containing a toner and forms a toner image on the image carrier surface, the toner being given color information and a color-generation state or non-color-generation state of the toner being controlled;

an intermediate transfer medium that the toner image formed on the image carrier is transferred to;

a first transfer unit that transfers the toner image formed on the image carrier surface to the intermediate transfer medium surface;

a color-generation information giving unit that directly gives color-generation information to the toner image transferred to the intermediate transfer medium;

a second transfer unit that transfers the toner image transferred to the intermediate transfer medium surface to a recording medium;

a fixing unit that fixes the toner image transferred to the recording medium surface; and a color generating unit that causes color generation in the toner image on the recording medium that the color-generation information is given, wherein the fixing unit is the color generating unit.

2. The image forming apparatus as described in claim 1, wherein the intermediate transfer medium has a reflectivity of about 75 to 99% on the peripheral side.

3. The image forming apparatus as described in claim 1, wherein the intermediate transfer medium contains a white conductive agent.

4. The image forming apparatus as described in claim 1, wherein the intermediate transfer medium has a surface layer containing a white conductive agent.

5. The image forming apparatus as described in claim 1, wherein the intermediate transfer medium is a belt member including a base material having Young's modulus of from about 2,000 MPa or more.

6. The image forming apparatus as described in claim 1, wherein the image carrier is a photoconductor, and the toner image forming unit has a charging device that produces electric charge on the photoconductor surface, an exposure device that forms an electrostatic latent image on the photoconductor surface by exposure, and a developing device that develops the electrostatic latent image with a developer containing the toner and forms a toner image.

7. The image forming apparatus as described in claim 1, further comprising a light irradiation device that irradiates the recording medium surface with light after fixing.

8. The image forming apparatus as described in claim 1, wherein the toner contains a first component and a second component that are present in an isolated condition from each other and generate color when react with each other, and a light-curable composition including either the first component or the second component, and performs its color-generation control by the state of the light-curable composition whether the light-curable composition being in a cured state or not by being given color-generation information.

* * * * *